US006598570B2

(12) United States Patent
Nakamura et al.

(10) Patent No.: US 6,598,570 B2
(45) Date of Patent: Jul. 29, 2003

(54) VARIABLE VALVE SYSTEM

(75) Inventors: Makoto Nakamura, Kanagawa (JP); Seinosuke Hara, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/935,159

(22) Filed: Aug. 23, 2001

(65) Prior Publication Data

US 2002/0035976 A1 Mar. 28, 2002

(30) Foreign Application Priority Data

Sep. 28, 2000 (JP) ..... 2000-295595

(51) Int. Cl.[7] ..... F01L 1/34
(52) U.S. Cl. ..... 123/90.15; 123/90.16
(58) Field of Search ..... 123/90.15, 90.16, 123/90.17, 90.27

(56) References Cited

U.S. PATENT DOCUMENTS 5,046,462 A 9/1991 Matayoshi et al. ..... 123/90.16
5,074,260 A * 12/1991 Yagi et al. ..... 123/90.16
5,388,552 A * 2/1995 Sugimoto et al. ..... 123/90.16
5,732,669 A * 3/1998 Fischer et al. ..... 123/90.16
6,123,053 A 9/2000 Hara et al. ..... 123/90.16

FOREIGN PATENT DOCUMENTS

JP 2000-38910 2/2000
JP 2000-197556 7/2000

* cited by examiner

*Primary Examiner*—Thomas Denion
*Assistant Examiner*—Jaime Corrigan
(74) *Attorney, Agent, or Firm*—Foley & Lardner

(57) ABSTRACT

A variable valve system for an internal combustion engine has a plurality of valves provided for one cylinder of the internal combustion engine. The plurality of the valves are disposed on one of an intake side and an exhaust side of the one cylinder. The plurality of the valves has a first valve, and a second valve. The variable valve system further has a first variable gear for variably controlling at least a lift of a valve lift characteristic of the first valve, and a second variable gear for variably controlling at least a lift of a valve lift characteristic of the second valve. The first variable gear and the second variable gear operate independently of each other.

22 Claims, 13 Drawing Sheets

VARIABLE VALVE SYSTEM

BACKGROUND OF THE INVENTION

The present invention relates to a variable valve system for an internal combustion engine.

More specifically, the present invention relates to a variable valve system which is provided with a plurality of variable gears for controlling valve lift characteristic and the like of an engine valve such as an intake valve and an exhaust valve.

U.S. Pat. No. 6,123,053 (equivalent of Japanese Patent Unexamined Publication No. 2000-38910 which is applied by the applicant of the present invention) discloses a variable valve system (referred to as "VARIABLE VALVE ACTUATION APPARATUS"). The variable valve system according to the above related art is applied to a movable valve gear which is provided with two intake valves for one cylinder. The variable valve system has a first variable gear and a second variable gear, each for variably controlling a valve lift characteristic of one of the respective two intake valves, namely, a first intake valve and a second intake valve, in such a manner that a lift of the first intake valve becomes different from a lift of the second intake valve, to thereby achieve engine performance in accordance with engine operating condition.

According to the above related art, however, only one control shaft is used for rotatably controlling the lift of each of the first variable gear and the second variable gear. Thereby, the two variable gears interlock with each other. In other words, the valve lift characteristic of one engine valve becomes a determinant of the valve lift characteristic of the other engine valve, causing insufficiency in engine performance in accordance with engine operating condition.

More specific description referring to FIG. 7 of the above related art is as follows. When the control shaft is rotated in a first direction so as to increase the lift, each of the first intake valve and the second intake valve has a large lift (same as each other). When the control shaft is rotated in a second direction opposite to the first direction, each of the first intake valve and the second intake valve has a small lift becoming smaller by degrees. With this, a lift difference is caused between the first intake valve and the second intake valve. The thus caused lift difference is gently increased.

Herein, engine perforce at low engine speed and light load is described as follows: The above increased lift difference between the first intake valve and the second intake valve encourages an intake air flow, to thereby improve combustion. Thereby, fuel consumption can be reduced in engine operating area.

On the other hand, engine performance at low engine speed and heavy load is described as follows: The gas flow causes an intake air loss (equivalent to the gas flow). Therefore, the lift must be increased so as to reduce the lift difference. However, after the piston passes over the bottom dead center, the increased lift difference ousts the mixture (that has been once introduced into the cylinder) at the latter period of lifting operation. Thereby, intake air filling efficiency is reduced, and output torque is likely to decrease. In high lift area, the lift difference cannot be reduced. Therefore, it is difficult to improve intake air flow effect at high engine speed area requiring high lift.

SUMMARY OF THE INVENTION

It is an object of the present invention to provide a variable valve system for an internal combustion engine.

According to the present invention, there is provided a variable valve system for an internal combustion engine. The variable valve system comprises a plurality of valves provided for one cylinder of the internal combustion engine. The plurality of the valves are disposed on one of an intake side and an exhaust side of the one cylinder. The plurality of the valves comprises a first valve, and a second valve. The variable valve system further comprises a first variable gear for variably controlling at least a lift of a valve lift characteristic of the first valve, and a second variable gear for variably controlling at least a lift of a valve lift characteristic of the second valve. The first variable gear and the second variable gear operate independently of each other.

The other objects and features of the present invention will become understood from the following description with reference to the accompanying drawings.

BRIEF DESCRIPTION OF THE DRAWINGS

FIG. 2 shows an operation of a first variable gear 1, according to the first preferred embodiment, in which.

DETAILED DESCRIPTION OF THE PREFERRED EMBODIMENT

Figure 1:
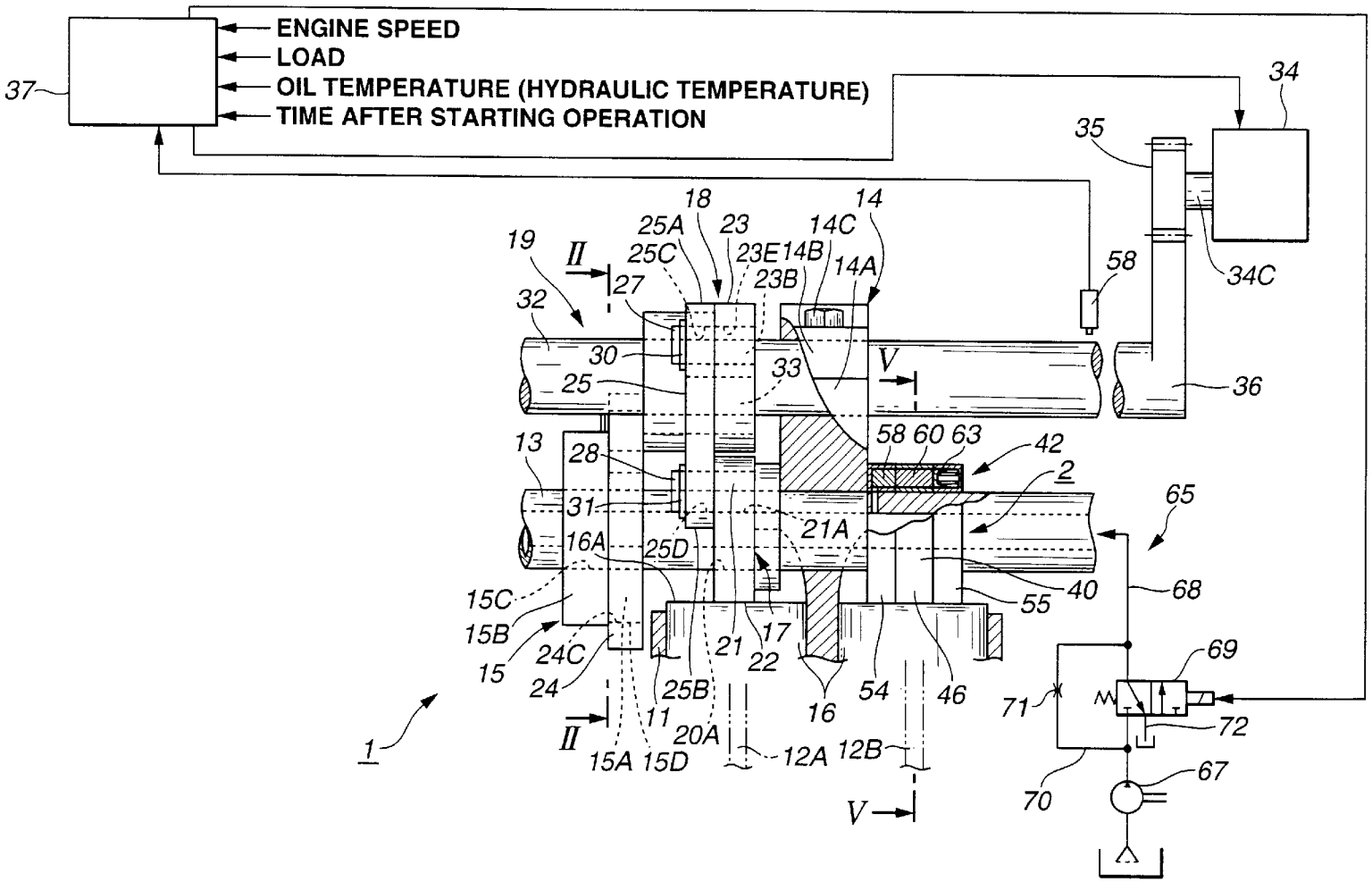
FIG. 1 is an essential side view of a variable valve system, according to a first preferred embodiment of the present invention.

As is seen in FIG. 1, there is provided a variable valve system, according to a first preferred embodiment of the present invention.

In FIG. 1, the variable valve system is applied to a movable valve gear which is provided with two intake valves for one cylinder, namely, a first intake valve 12A and a second intake valve 12B. The first intake valve 12A and the second intake valve 12B are slidably mounted, by way of a valve guide (not shown), to a cylinder head 11. The variable valve system is provided with a first variable gear 1 and a second variable gear 2. In accordance with engine operating condition, the first variable gear 1 variably controls lift of the first intake valve 12A continuously, while the second variable gear 2 variably controls lift of the second intake valve 12B stepwise. The first variable gear 1 and the second variable gear 2 are allowed to operate independently of each other.

Hereinafter, there is described a constitution of the first variable gear 1.

Figure 2A:
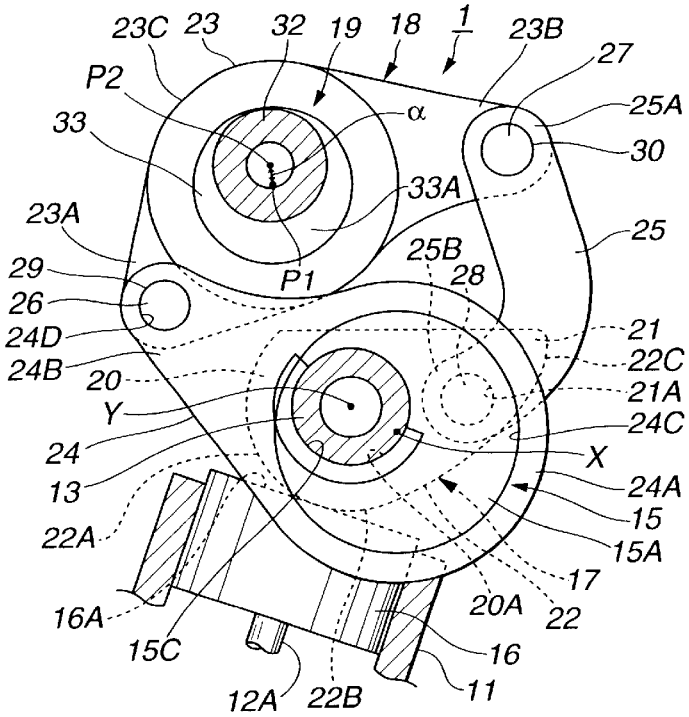
FIG. 2A is a cross section II—II in FIG. 1 showing a closed valve operation when the first variable gear 1 is controlled at a maximum lift.
Figure 2B:
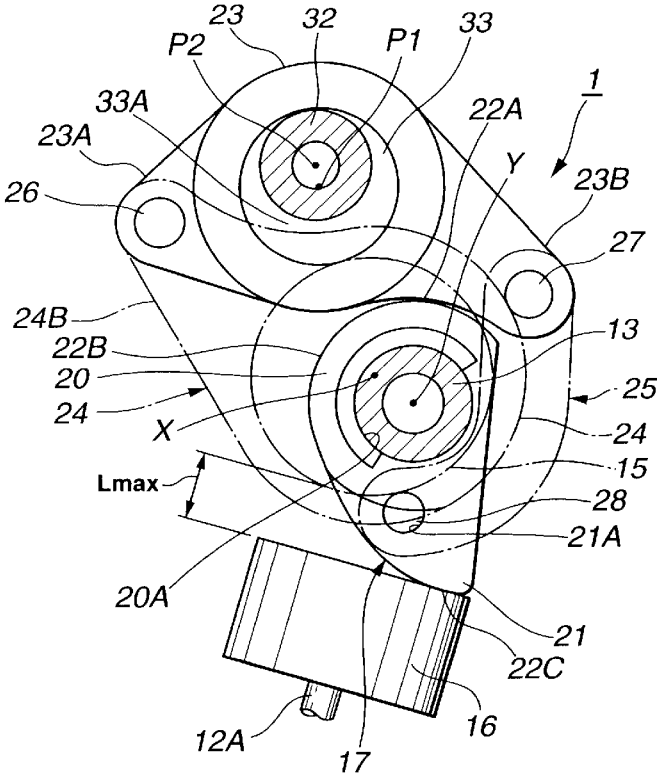
FIG. 2B is a cross section II—II in FIG. 1 showing an open valve operation when the first variable gear 1 is controlled at the maximum lift.
Figure 3:
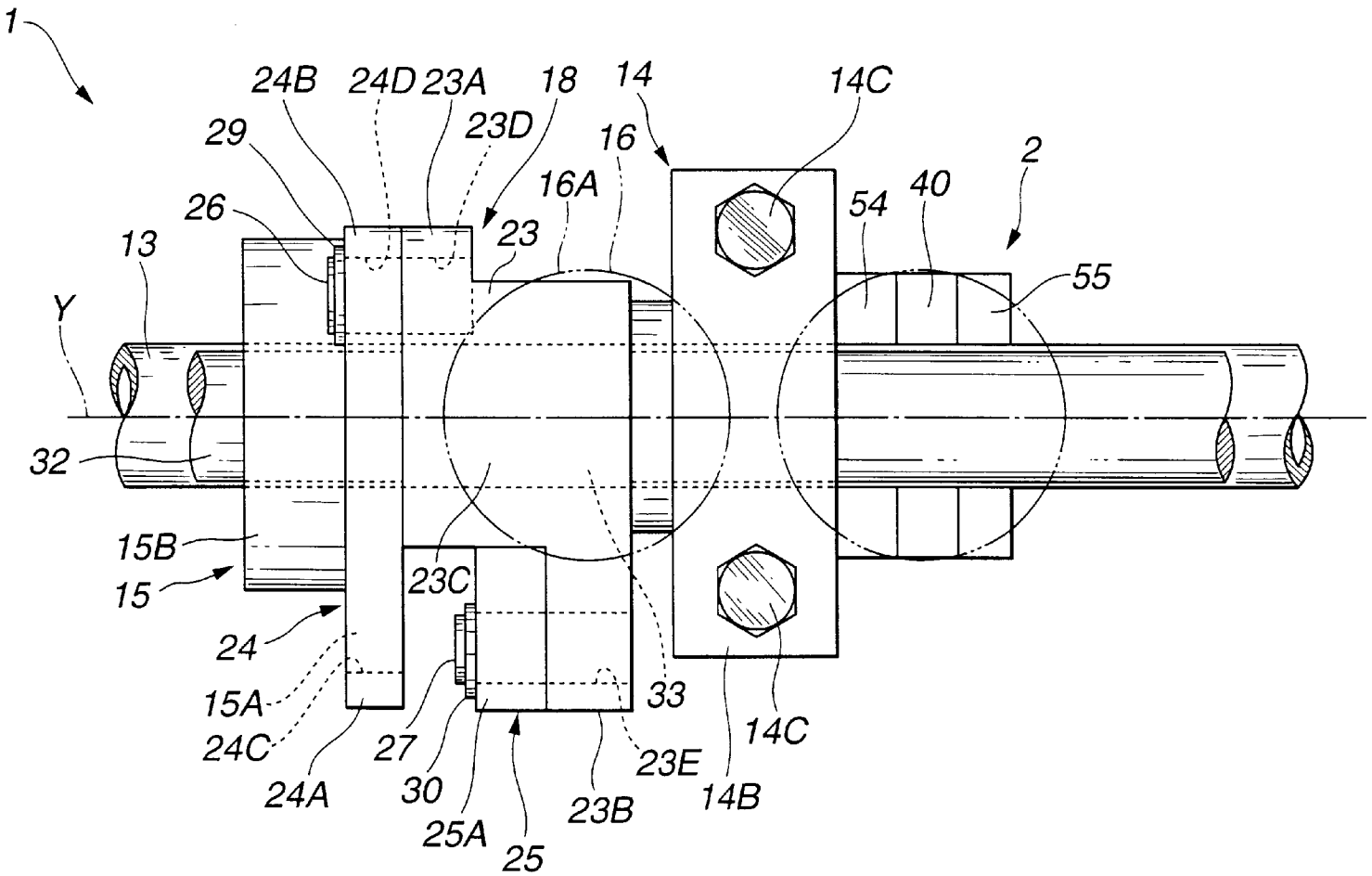
FIG. 3 is a plan view of the first variable gear 1.

As is seen in FIG. 1 to FIG. 3, the first variable gear 1 is provided with a drive shaft 13, a drive cam 15, a swing cam 17, a transmission gear 18, and a control gear 19. The drive shaft 13 is rotatably supported to a bearing 14 at an upper end portion of the cylinder head 11, and is hollow in shape. The drive cam 15 is an eccentrically rotational cam which is fixed to the drive shaft 13 through press fitting and the like. The swing cam 17 is swingably supported to the drive shaft 13. The swing cam 17 slidably abuts on a flat upper surface of a valve lifter 16 (which is disposed at an upper end of the first intake valve 12A), and opens the first intake valve 12A. The transmission gear 18 communicates between the drive cam 15 and the swing cam 17, and transmits a rotational force of the drive cam 15 as a swing force of the swing cam 17. The control gear 19 variably controls an operating position of the transmission gear 18.

The drive shaft 13 is disposed in a forward-and-backward direction of an engine. A rotational force is transmitted from a crank shaft of the engine, by way of a timing chain and the like, to the drive shaft 13. The timing chain is wound around a driven sprocket (not shown) which is a follower disposed at a first end of the drive shaft 13.

As is seen in FIG. 1, the bearing 14 is provided with a main bracket 14A and a sub-bracket 14B. The main bracket 14A is disposed at the upper end portion of the cylinder head 11, and supports an upper portion of the drive shaft 13. The sub-bracket 14B is disposed at an upper end portion of the main bracket 14A, and rotatably supports a control shaft 32 (to be described afterward). Both the main bracket 14A and the sub-bracket 14B are commonly tightened downward with a pair of bolts 14C (FIG. 3).

As is seen in FIG. 2A and FIG. 2B, the drive cam 15 is shaped substantially into a ring. As is seen in FIG. 1, the drive cam 15 is constituted of a cam body 15A, and a barrel portion 15B which is integrated on an external end surface of the cam body 15A. Moreover, the drive cam 15 has therein a through hole 15C for the drive shaft 13 to pass through axially. As is seen in FIG. 2A and FIG. 2B, the cam body 15A defines a shaft center X which is offset, by a predetermined distance, radially from a shaft center Y of the drive shaft 13. Moreover, on an outside of the valve lifter 16 (horizontally left in FIG. 1) where no interference is caused to the valve lifter 16 with the drive cam 15, the drive shaft 13 is press fitted to the drive cam 15, by way of the through hole 15C.

As is seen in FIG. 2A and FIG. 2B, the swing cam 17 is shaped substantially into an alphabetical "U (or J)". The swing cam 17 has a first end having a base end portion 20 which is substantially circular in shape. The base end portion 20 is formed with a through hole 20*a* for allowing the drive shaft 13 to penetrate therethrough, to thereby rotatably support the drive shaft 13. The swing cam 17 further has a second end defining a cam nose portion 21 which is formed with a pin hole 21A. Moreover, the swing cam 17 has a lower surface which is formed with a cam surface 22. The cam surface 22 is formed of a base circle surface 22A, a ramp surface 22B, and a lift surface 22C. The base circle surface 22A is defined in the vicinity of the base end portion 20. The ramp surface 22B extends from the base circle surface 22A toward the cam nose portion 21 in such a manner as to form substantially a circular arc. The lift surface 22C is disposed at a head end (right in FIG. 2A) of the ramp surface 22B. Each of the base circle surface 22A, the ramp surface 22B, and the lift surface 22C is allowed to abut on a predetermined position on an upper surface 16A of the valve lifter 16, corresponding to swing position of the swing cam 17.

As is seen in FIG. 2A and FIG. 2B, the transmission gear 18 is constituted of a rocker arm 23, a link arm 24, and a link rod 25. The rocker arm 23 is disposed at an upper portion of the drive shaft 13. The link arm 24 links a first end portion 23A of the rocker arm 23 to the drive cam 15. The link rod 25 links a second end portion 23B of the rocker arm 23 to the swing cam 17.

As is seen in FIG. 3, each rocker arm 23 is bent in such a manner as to form substantially a crank in plan view. In the center of the rocker arm 23, there is provided a barrel base portion 23C which is rotatably supported to a control cam 33 (to be described afterward). Moreover, as is seen in FIG. 2A, FIG. 2B, and FIG. 3, the first end portion 23A protrudes at each external end portion (upper in FIG. 3) of the barrel base portion 23C. At the first end portion 23A, there is formed a pin hole 23D for inserting therethrough a pin 26 which is connected to the link arm 24 so as to rotate relative to the link arm 24. Contrary to this, as is also seen in FIG. 2A, FIG. 2B, and FIG. 3, the second end portion 23B protrudes at each internal end portion (lower in FIG. 3) of the barrel base portion 23C. At the second end portion 23B, there is formed a pin hole 23E for inserting therethrough a pin 27 which is connected to a first end portion 25A of the link rod 25 so as to rotate relative to the link rod 25.

Moreover, as is seen in FIG. 2A, FIG. 2B, and FIG. 3, the link arm 24 is constituted of a base portion 24A and a protruding end 24B. The base portion 24A is comparatively large in diameter, and is shaped substantially into an annulus ring. The protruding end 24B protrudes at a predetermined position on an external peripheral surface of the base portion 24A. In the center of the base portion 24A, there is formed an engagement hole 24C which rotatably engages with an external peripheral surface of the cam body 15A of the drive cam 15. Contrary to this, at the protruding end 24B, there is formed a pin hole 24D for rotatably inserting therethrough the pin 26.

Moreover, as is seen in FIG. 2A and FIG. 2B, the link rod 25 is bent substantially into a reversed alphabetical "L" having a predetermined length. As is seen in FIG. 1, the link rod 25 has the first end portion 25A formed with a pin hole 25C for rotatably inserting therethrough an end portion of the pin 27, and a second end portion 25B formed with a pin hole 25D for rotatably inserting therethrough an end portion of a pin 28. The pin 27 is the one that is inserted through the pin hole 23E defined at the second end portion 23B of the rocker arm 23, while the pin 28 is the one that is inserted through the pin hole 21A defined at the cam nose portion 21 of the swing cam 17.

The link rod 25 controls the swing cam 17 so that the swing cam 17 makes a maximum swing motion within an area defined by swing motion of the rocker arm 23.

Each of the pin 26, the pin 27 and the pin 28 is provided with a first end having, respectively, a snap ring 29, a snap ring 30, and a snap ring 31 for controlling movement of the link rod 25 in an axial direction.

As is seen in FIG. 1, the control gear 19 is constituted of the control shaft 32, the control cam 33, an electric motor 34, and a controller 37. The control shaft 32 is disposed in the forward-and-backward direction of the engine. The control cam 33 is fixed to an external periphery of the control shaft 32, and acts as a swing fulcrum of the rocker arm 23. The electric motor 34 is an electric actuator 34 for controlling rotational position of the control shaft 32. The controller 37 controls the electric motor 34.

The control shaft 32 is disposed substantially in parallel to the drive shaft 13. As described above, the control shaft 32 is rotatably supported between a bearing groove (disposed at the upper end portion of the main bracket 14A of the bearing 14), and the sub-bracket 14B of the bearing 14. On the other hand, each control cam 33 is substantially cylindrical in shape. As is seen in FIG. 2A and FIG. 2B, the control cam 33 has a shaft center P1 which is shifted by an interval of $\alpha$ (excursion) from the shaft center P2 of the control shaft 32.

As is seen in FIG. 1, the electric motor 34 transmits a rotational force (torque), by way of mesh between a first spur gear 35 and a second spur gear 36, to the control shaft 32. The first spur gear 35 is disposed at a head end of the drive shaft 34C, while the second spur gear 36 is disposed at a back end of the control shaft 32.

The controller 37 outputs a control signal to the electric motor 34 in accordance with an engine operating condition which is detected by means of various sensors, to thereby drive the first variable gear 1. Included in the sensors are; a crank angle sensor, an air flow meter, a water temperature sensor, a throttle valve open angle sensor, and the like (each of which is not shown).

Hereinafter, there is described a fundamental operation (control) of the first variable gear 1.

Figure 4:
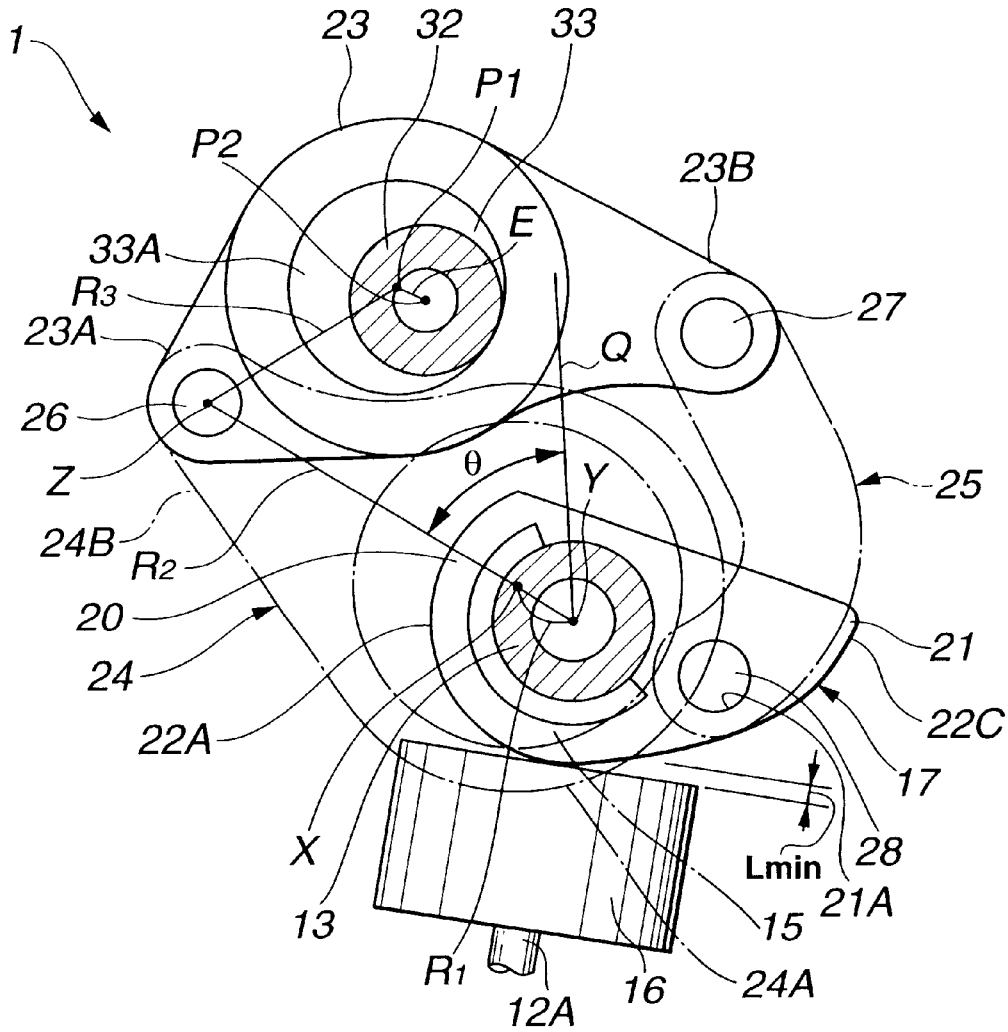
FIG. 4 is the first variable gear 1 when being controlled at a minimum lift Lmin, according to the first preferred embodiment.

Described at first is in terms of a small (low) lift operation by means of the first variable gear 1. The control signal sent from the controller 37, by way of the electric motor 34, allows the control shaft 32 to be rotatably controlled in a first rotational direction. As is seen in FIG. 4, the shaft center P1 of the control cam 33 is held at a substantially leftward-and-upward rotational position from the shaft center P2 of the control shaft 32. A thick wall portion 33A of the control cam 33 rotates upward in such a manner as to be spaced apart from the drive shaft 13. Thereby, substantially an entire part of the rocker arm 23 moves upward relative to the drive shaft 13. Thereby, the swing cam 17 is forcibly pulled up by way of the link rod 25, to thereby rotate in a counterclockwise direction in FIG. 4. Therefore, the above change in attitude (or position) of the transmission gear 18 allows the drive cam 15 to rotate, to thereby push up the first end portion 23A of the rocker arm 23, by way of the link arm 24. Then, a lift caused by the "push up" is transmitted, by way of the link rod 25, to the swing cam 17 and the valve lifter 16. As is seen in FIG. 4, the lift L is denoted by an Lmin (small lift, or minimum lift).

Described next is in terms of a large (high) lift operation by means of the first variable gear 1. The control signal sent from the controller 37, by way of the electric motor 34, allows the control shaft 32 to be rotatably controlled in a second rotational direction opposite to the first rotational direction. Thereby, the control cam 33 rotates to the position in FIG. 2A and FIG. 2B, to thereby rotate the thick wall portion 33A downward. Thereby, the substantially entire part of the rocker arm 23 moves downward toward the drive shaft 13. Thereby, the second end portion 23B presses down the swing cam 17 by way of the link rod 25, to thereby rotate the entire swing cam 17 in a clockwise direction to a predetermined extent. Therefore, the above change in attitude (or position) of the transmission gear 18 allows the drive cam 15 to rotate, to thereby push up the first end portion 23A of the rocker arm 23, by way of the link arm 24. Then, the lift caused by the "push up" is transmitted, by way of the link rod 25, to the swing cam 17 and the valve lifter 16. As is seen in FIG. 2B, the lift L is maximized to an Lmax.

Varying the position of the control shaft 32 continuously allows the lift L to vary continuously between the lift Lmax and the lift Lmin.

Hereinafter, there is described a constitution of the second variable gear 2.

Figure 5:
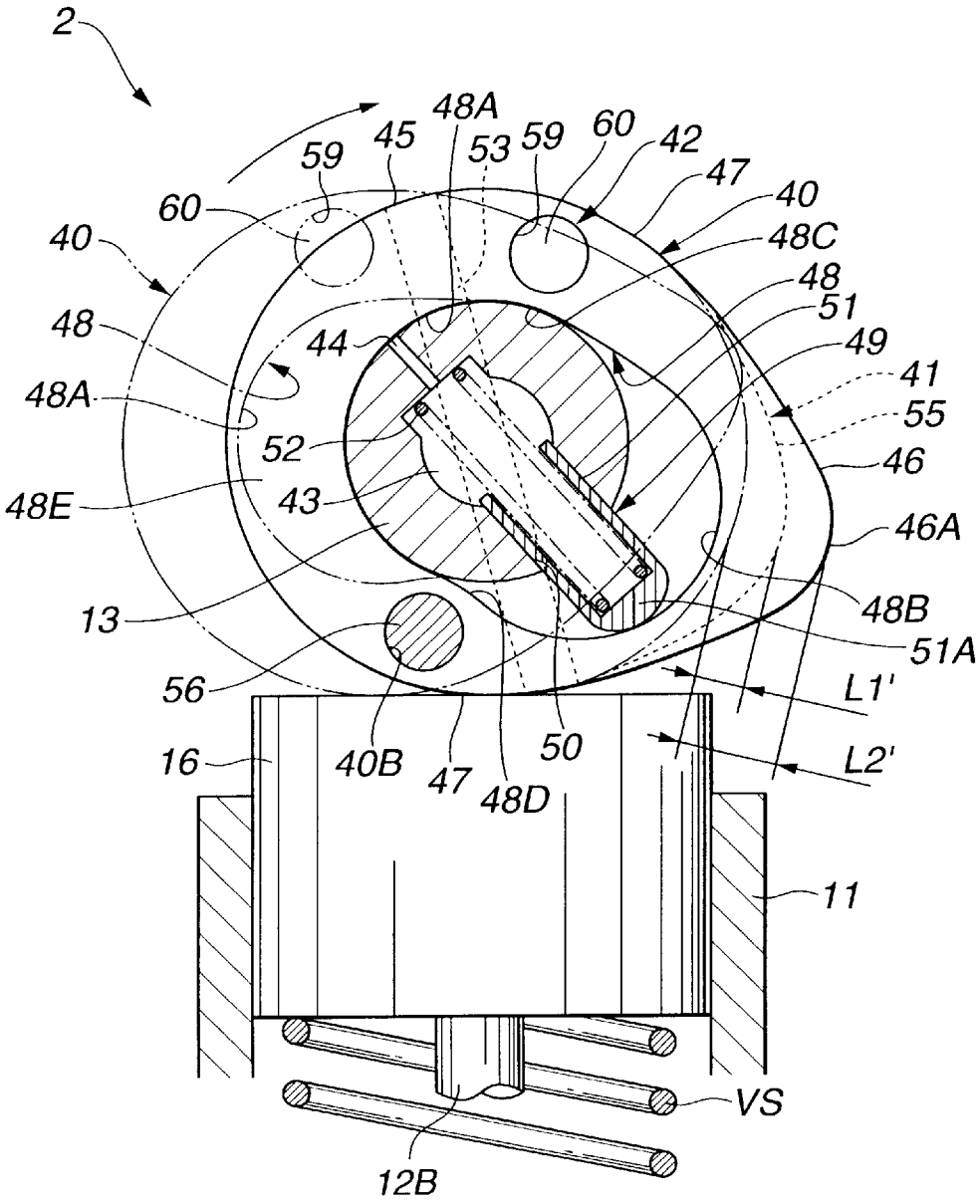
FIG. 5 is a cross section V—V in FIG. 1, showing a second variable gear 2, according to the first preferred embodiment.
Figure 6:
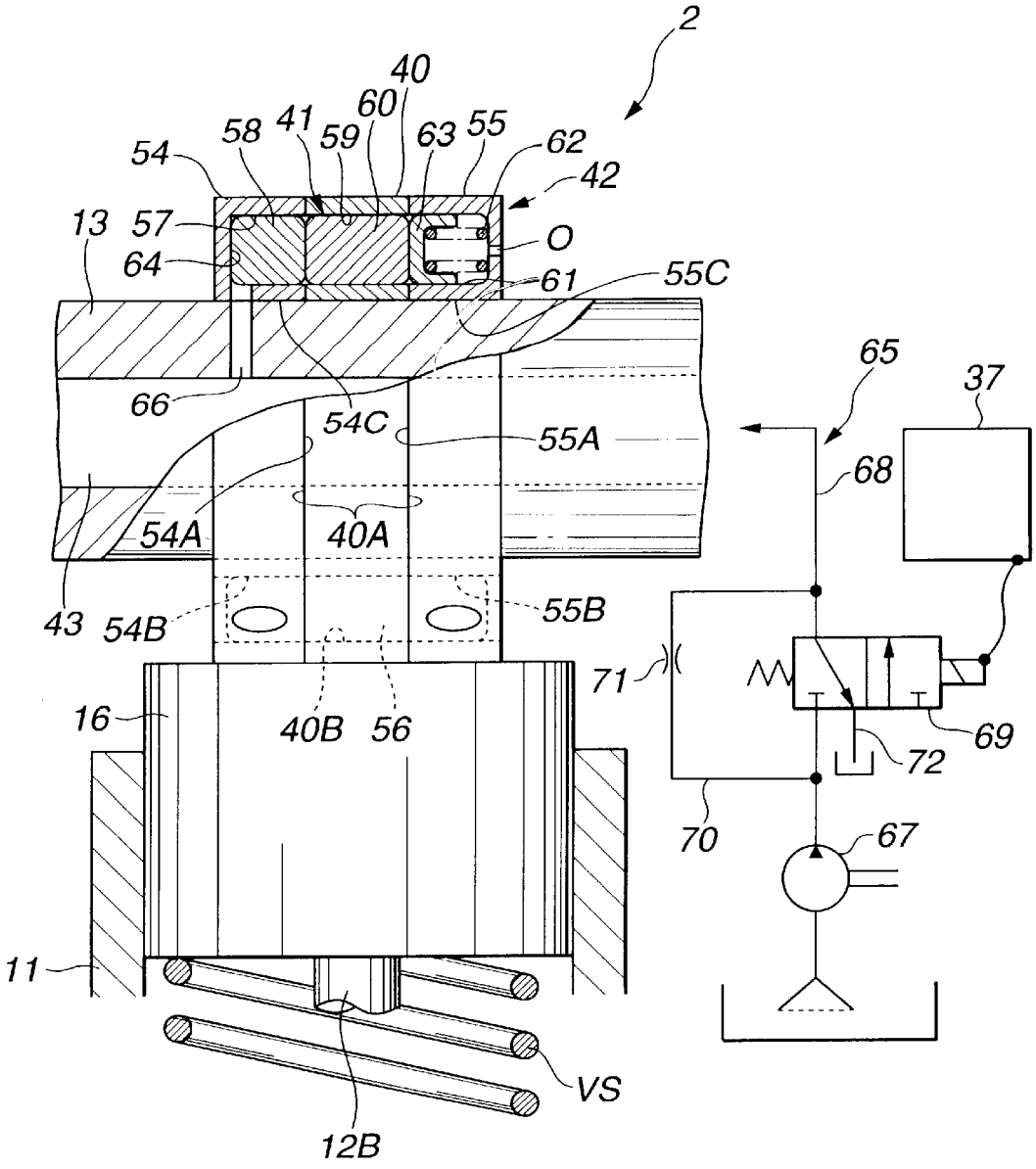
FIG. 6 is an essential part of the second variable gear 2.

As is seen in FIG. 1, the first variable gear 1 and the second variable gear 2 are disposed in series. As is seen in FIG. 5 and FIG. 6, the second variable gear 2 is, however, completely different from the first variable gear 1 in constitution and completely independent of the first variable gear 1 in terms of lift control (for controlling the second intake valve 12B). With the second variable gear 2, the lift control is carried out by two steps. Herein, the first variable gear 1 and the second variable gear 2 are so constituted as to vary independently of each other.

The second variable gear 2 is constituted of a movable cam 40, a support gear 41, and an engagement-disengagement measures 42. The movable cam 40 is disposed around an external periphery of the drive shaft 13 in such a manner as to move radially relative to the drive shaft 13. Moreover, by way of the valve lifter 16, the movable cam 40 opens the second intake valve 12B, opposing a spring force of a valve spring VS. The valve lifter 16 is a covered member, is cylindrical in shape, and is of direct-drive type. The support gear 41 (FIG. 5) is disposed around the external periphery of the drive shaft 13, and pivotally supports an end portion of the movable cam 40. The engagement-disengagement measures 42 engages the movable cam 40 fixedly with the drive shaft 13, and disengages the movable cam 40 from the drive shaft 13, in accordance with the engine operating condition.

The drive shaft 13 is formed with an oil passage 43. The oil passage 43 is supplied with pressure oil from an oil hydraulic circuit 65 (to be described afterward) toward an internal axial center (FIG. 6). In an internal radial direction in which the movable cam 40 of the drive shaft 13 is positioned, there is formed a small hole 44 (FIG. 5) communicating with the oil passage 43.

The movable cam 40 is constituted of a base circle portion 45, a cam lift portion 46, and a ramp portion 47. The base circle portion 45 is substantially circular in shape, and has a profile substantially shaped into a rain drop. The cam lift portion 46 protrudes in a form of a steep mountain at an end of the base circle portion 45. The ramp portion 47 is formed between the base circle portion 45 and the cam lift portion 46. Each of the base circle portion 45, the cam lift portion 46 and the ramp portion 47 rotatably slidably abuts on substantially the middle section on an upper surface of the valve lifter 16.

Moreover, in substantially the center of the movable cam 40, there is formed an elongate hole 48 (through hole) which engages with the drive shaft 13, for a sliding movement of the drive shaft 13. As is seen in FIG. 5, the elongate hole 48 is formed substantially along a radial direction of the drive shaft 13, and is shaped substantially into a cocoon. The elongate hole 48 has a first end portion 48A which is substantially circular and is disposed in the center of the base circle portion 45. Moreover, the elongate hole 48 has a second end portion 48B which is disposed at a head end portion 46A of the cam lift portion 46. There is defined a first end surface 48C between the first end portion 48A and the second end portion 48B. The first end surface 48C is smooth, and forms a continuous surface shaped substantially into a circular arc. There is also defined a second end surface 48D opposite to the first end surface 48C. The second end surface 48D forms a smooth protrusion.

As is seen in FIG. 5, the movable cam 40 has a side defining the cam lift portion 46. By dint of a bias measures 49, the side defining the cam lift portion 46 is so disposed as to be movable in a protrusion direction by way of the elongate hole 48. More specifically, as is seen in FIG. 5, the bias measures 49 is constituted of a plunger hole 50, a plunger 51, and a return spring 52. The plunger hole 50 is formed substantially along a radial direction of the drive shaft 13. The plunger 51 is slidably disposed in the plunger hole 50. The return spring 52 biases the plunger 51 in a direction of an internal peripheral surface of the elongate hole 48.

The plunger hole 50 has a base portion which is so formed as to cross the oil passage 43. The plunger 51 is a covered member, and is substantially circular in shape. The plunger 51 slides in the plunger hole 50 forward and backward. Moreover, the plunger 51 has a head end portion 51A having a surface which is substantially spherical in shape and directs the internal peripheral surface of the elongate hole 48. The return spring 52 has a first end portion which is elastically held at the base portion of the plunger hole 50, and a second end portion which is elastically held at an internal hollow base surface of the plunger 51. Moreover, the return spring 52 has a coil length which is so defined that a spring force of the return spring 52 becomes substantially zero when the cam lift portion 46 of the movable cam 40 presents a maximum protrusion.

As is seen in FIG. 5 and FIG. 6, the support gear 41 is constituted of a pair of a first flange portion 54 and a second flange portion 55, and a support pin 56. The first flange portion 54 is disposed on a side defining a first side surface 40*a* (left in FIG. 6), while the second flange portion 55 is disposed on a side defining a second side surface 40*a* (right in FIG. 6). The first flange portion 54 is fixed to the drive shaft 13 by means of a first fix pin 53 which diametrally penetrates through the first flange portion 54 and the drive shaft 13, while the second flange portion 55 is fixed to the drive shaft 13 by means of a second fix pin 53 (FIG. 5) which diametrally penetrates through the second flange portion 55 and the drive shaft 13. The support pin 56 penetrates through the pair of the first flange portion 54 and the second flange portion 55, and the movable cam 40, to thereby pivotally support the movable cam 40.

Each of the first flange portion 54 and the second flange portion 55 has a cam portion which defines a small lift L1'. The first flange portion 54 is formed with an engagement hole 54C (FIG. 6) for engaging with the drive shaft 13, while the second flange portion 55 is formed with an engagement hole 55C (FIG. 6) for engaging with the drive shaft 13. Moreover, each of the first flange portion 54 and the second flange portion 55 has a base circle portion which has an external diameter substantially the same as that of the base circle portion 45 of the movable cam 40. Moreover, as is seen in FIG. 6, the first flange portion 54 has an inside surface 54A slidably abutting on the first side surface 40A (left in FIG. 6), while the second flange portion 55 has an inside surface 55A (opposite to the inside surface 54A) slidably abutting on the second side surface 40A (right in FIG. 6). Furthermore, each of the first flange portion 54 and the second flange portion 55 has an external peripheral surface. When the cam lift portion 46 (FIG. 5) of the movable cam 40 moves backward, each of the external peripheral surface of one of the respective first flange portion 54 and the second flange portion 55 abuts on an upper surface of the valve lifter 16, putting therebetween the movable cam 40, to thereby lift the valve lifter 16 (by the small lift L1') and the valve (by the small lift L1').

The support pin 56 is inserted through a first pin hole 54B and a second pin hole 55B which are formed, respectively, on an external peripheral side of the first flange portion 54 and the second flange portion 55. Moreover, the support pin 56 is inserted through an insertion hole 40B (though hole) which is formed on a side defining the second end surface 48D (smooth protrusion) of the elongate hole 48. The support pin 56 is press fitted into each of the first pin hole 54B and the second pin hole 55B. Contrary to this, the support pin 56 is slidable in the insertion hole 40B, so as to allow the movable cam 40 to move freely (or swingably).

As is seen in FIG. 5 and FIG. 6, the engagement-disengagement measures 42 is constituted of a receiving hole 57, an engagement piston 58, an engagement hole 59, a press piston 60, a bias piston 63, and an oil hydraulic circuit 65.

The receiving hole 57 has a base, and is disposed at the external end portion of the first flange portion 54 in such a manner as to be drilled from the inside surface 54A in a direction of the internal shaft. The engagement piston 58 is slidably disposed outwardly from inside the receiving hole 57. The engagement hole 59 is so formed as to penetrate in a direction of the internal shaft at a predetermined angular position circumferentially, which angular position is defined relative to the insertion hole 40B of the movable cam 40, as is best seen in FIG. 5. Moreover, the engagement hole 59 coincidentally opposes the receiving hole 57 in a predetermined area when the movable cam 40 is in the base circle position. The press piston 60 is slidably disposed in the engagement hole 59, and has a first end surface which is adapted to oppositely abut on a first end surface of the engagement piston 58. The bias piston 63 has a spring member 62 having a spring force for moving the engagement piston 58 backward from inside a hold hole 61, by way of the press piston 60. The hold hole 61 has a base wall, and is disposed at an external end portion of the second flange portion 55 in such a manner as to be symmetrical to the receiving hole 57. The oil hydraulic circuit 65 takes such alternative two functions as supplying pressure oil to a pressure oil chamber 64, and removing the pressure oil from the pressure oil chamber 64. The pressure oil chamber 64 is formed at a base portion of the receiving hole 57. The press piston 60, the bias piston 63, and the spring member 62 constitute a bias mechanism.

The base wall of the hold hole 61 is formed with a drilled air vent hole 0 having a small diameter, so as to allow the bias piston 63 to slide freely.

The engagement piston 58 is equal in length axially to the corresponding receiving hole 57, while the press piston 60 is equal in length axially to the corresponding engagement hole 59. Contrary to this, the bias piston 63 is shorter in length axially than the hold hole 61. Moreover, the engagement hole 59 is so positioned that a head end portion (left in FIG. 6) and a back end portion (right in FIG. 6) of the press piston 60 opposes, respectively, the inside surface 54A (of the first flange portion 54) and the inside surface 55A (of the second flange portion 55), the inside surface 54A and the inside surface 55A opposing each other inward. The above opposition of the press piston 60 is not influenced even when the cam lift portion 46 is moved backmost.

As is seen in FIG. 6, the oil hydraulic circuit 65 is constituted of an oil hole 66, an oil passage 68, an electromagnetic switch valve 69 (cam selector 69), and an orifice 71. The oil hole 66 is drilled in an internal radial direction of the drive shaft 13, and allows the pressure oil chamber 64 to communicate with the oil passage 43. The oil passage 68 has a first end which communicates with the oil passage 43, and a second end which communicates with an oil pump 67. The electromagnetic switch valve 69 is of two-way type, and is disposed between the oil pump 67 and the oil passage 43. The orifice 71 is disposed in a bypass passage 70 which bypasses from the electromagnetic switch valve 69.

The electromagnetic switch valve 69 is connected to a drain passage 72 which is adapted to communicate with the oil passage 43. Moreover, the electromagnetic switch valve 69 switchably turns on the oil passage 43 and the drain passage 72 based on the control signal from the same controller 37 that is used for the first variable gear 1 in FIG. 1.

The controller 37 outputs the control signal to the electromagnetic switch valve 69 in accordance with the engine operating condition which is detected by means of various sensors. Included in the sensors are, as described in the description of the constitution of the first variable gear 1 above; the crank angle sensor, the air flow meter, the water temperature sensor, the throttle valve open angle sensor, and the like (each of which is not shown).

Hereinafter, there is described a fundamental operation (control) of the second variable gear 2.

Described at first is in terms of a small (low) lift operation of the second variable gear 2. The control signal sent from the controller 37 allows the electromagnetic switch valve 69 to block an upper stream side of the oil passage 68, and allows the oil passage 68 to communicate with the drain passage 72. Thereby, the pressure oil is not supplied to the pressure oil chamber 64. As is seen in FIG. 5 and FIG. 6, this allows the engagement piston 58, the press piston 60 and the bias piston 63 to be received, respectively, in the receiving hole 57, the engagement hole 59, and the hold hole 61. Thereby, the drive shaft 13 is disengaged from the movable cam 40.

As is seen in FIG. 5, a rotation of the drive shaft 13 involves a synchronous rotation with the first flange portion 54 and the second flange portion 55. The above synchronous rotation causes the movable cam 40 to make a synchronous rotation, by way of the support pin 56, with the drive shaft 13. As is seen in FIG. 5, the movable cam 40 has an external peripheral surface which slidably abuts on an upper surface of the valve lifter 16. This slidable abutment is carried out by the following three sequential portions: 1. the base circle portion 45. 2. the ramp portion 47. 3. the cam lift portion 46. Thereafter, the spring force of the valve spring VS is applied to the cam lift portion 46. Thereby, the spring force of the return spring 52 pushes back the plunger 51, to thereby allow the entire part of the movable cam 40 to swing, by way of the elongate hole 48, in the counterclockwise direction in FIG. 5, with the support pin 56 acting as a swing fulcrum. In other words, the cam lift portion 46 moves backward, to thereby allow the second end portion 48B of the elongate hole 48 to approach the drive shaft 13. As a result, the small lift cam mountain of the first flange portion 54 and the second flange portion 55 causes a valve lift.

Thereafter, the movable cam 40 makes a further rotation, to thereby have the ramp portion 47 (opposite side) abut on the upper surface of the valve lifter 16. Thereby, engagement portion (of the elongate hole 48) to the drive shaft 13 is shifted from the second end portion 48B to the first end portion 48A. Thereby, the spring force of the return spring 52 allows the cam lift portion 46 to move forward by way of the plunger 51. Moreover, the movable cam 40 makes a still further rotation, to thereby have an area (which is occupied by the base circle portion 45) abut on the upper surface of the valve lifter 16. This allows the cam lift portion 46 to make a maximum forward movement.

In this engine operating area, the movable cam 40 makes the synchronous rotation with the drive shaft 13. However, the movable cam 40 does not lift a second intake valve 12B of another cylinder, by slidably abutting on the upper surface of the valve lifter 16 continuously in a manner not to exceed the lift that is defined by the small lift cam mountain of the first flange portion 54 and the second flange portion 55. Therefore, in terms of the cam lift, the second variable gear 2 shows the small lift L1' from the small lift cam mountain of each of the first flange portion 54 and the second flange portion 55. Thereby, in terms of the valve lift, the second intake valve 12B shows the small lift L1'.

Even when the electromagnetic switch valve 69 blocks supply of the pressure oil to the pressure oil chamber 64 (as described above), the pressure oil discharged from the oil pump 67 is partially supplied, by way of the orifice 71 of the bypass passage 70, to the oil passage 43. Thereafter, the thus partially supplied pressure oil is delivered from the oil passage 43, by way of the oil hole 66, into the pressure oil chamber 64 and the like (a small amount of pressure oil), for lubrication of members. Moreover, the pressure oil is also supplied from the small hole 44 (FIG. 5) to a substantially crescent gap 48E (FIG. 5). The crescent gap 48E is formed between the external peripheral surface of the drive shaft 13 and the internal peripheral surface of the first end portion 48A of the elongate hole 48. The thus supplied pressure oil (small amount) restricts the movable cam 40 from making a quick forward movement. The quick forward movement is the one that may be caused when the "abutment" of the movable cam 40 on the upper surface of the valve lifter 16 passes over the ramp portion 47 for a maximum forward movement of the cam lift portion 46. In other words, the thus supplied pressure oil (small amount) acts as a damper. Thereby, what is called a "click phenomenon" is prevented which may be caused when the above "abutment" moves from the cam lift portion 46 to the ramp portion 47. The prevention of the click phenomenon prevents hammering noise and wear which may be caused when a light collision occurs between the upper surface of the valve lifter 16 and the external peripheral surface of the movable cam 40, and another light collision between the external peripheral surface of the drive shaft 13 and the internal peripheral surface of the first end portion 48A of the elongate hole 48.

On the other hand, described next is in terms of a large (high) lift operation of the second variable gear 2. As is seen in FIG. 6, the control signal outputted from the controller 37 causes the electromagnetic switch valve 69 to make a switching operation, to thereby block the drain passage 72, and allow the pressure oil to communicate between upstream and downstream of the oil passage 68. Thereby, the pressure oil discharged from the oil pump 67 is takes the following sequential route: the oil passage 68, the oil passage 43, the oil hole 66, and the pressure oil chamber 64 (destination). At a point in time when the movable cam 40 rotates to have the base circle portion 45 oppose the upper surface of the valve lifter 16 (in other words, when the receiving hole 57, the engagement hole 59, and the hold hole 61 coincide with each other in a base circle area), the following operation is observed:

High pressure oil in the pressure oil chamber 64 causes a head end portion (right in FIG. 6) of the engagement piston 58 to move forward, opposing the spring force of the spring member 62. This allows the engagement piston 58 to engage in the engagement hole 59, pushing back (rightward in FIG. 6) the press piston 60 and the bias piston 63. Simultaneously with this, a second end portion (right in FIG. 6) of the press piston 60 engages in the hold hole 61.

Thereby, in a condition that the cam lift portion 46 makes the maximum forward movement, the movable cam 40 fixedly engages with the first flange portion 54 and the second flange portion 55 so as to be integrally connected to the drive shaft 13.

As a result, the second intake valve 12B achieves the large lift cam operation.

Based on the fundamental constitution of each of the first variable gear 1 and the second variable gear 2 that are independent of each other, the controller 37 also carries out a relative control between the first variable gear 1 and the second variable gear 2. In accordance with the engine operating condition, the controller 37 carries out switching between the first variable gear 1 and the second variable gear 2, to thereby vary the valve lift characteristic of each of the first intake valve 12A (by means of the first variable gear 1) and the second intake valve 12B (by means of the second variable gear 2), as is seen in FIG. 7.

Figure 7:
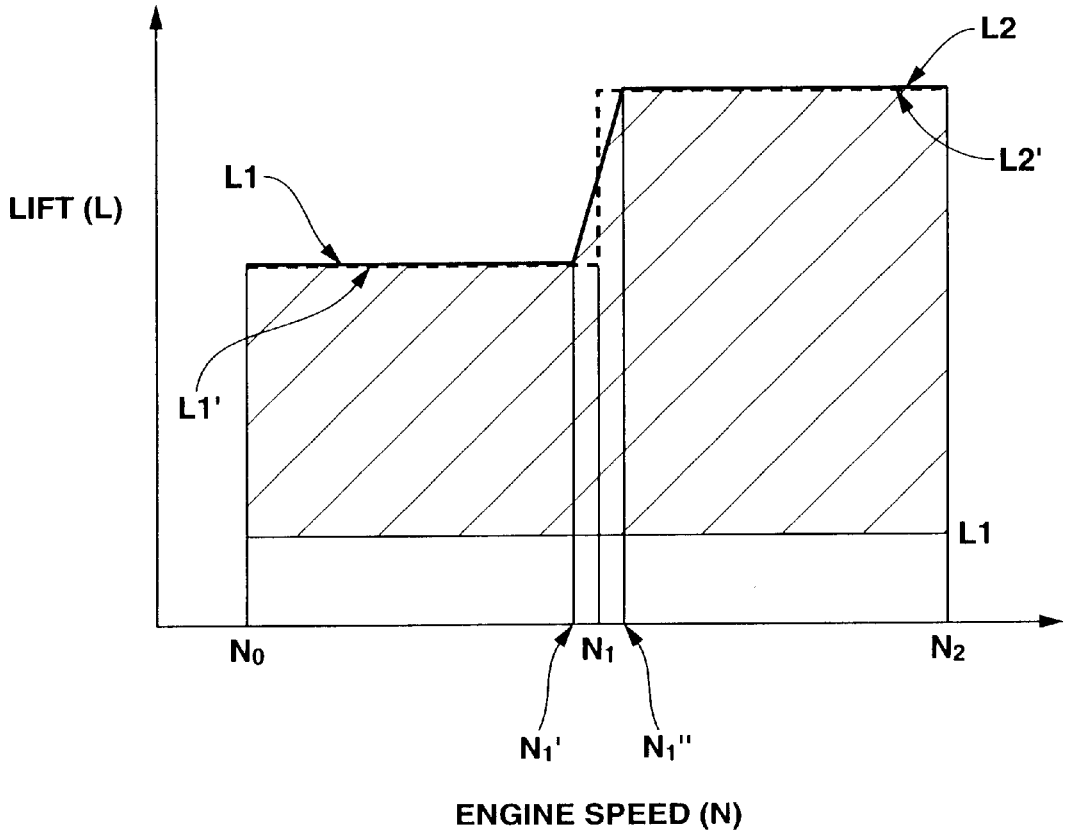
FIG. 7 shows valve lift characteristics by means of the first variable gear 1 and the second variable gear 2, according to the first preferred embodiment.

More specifically, as is seen in FIG. 7, the abscissa is engine speed N ranging from an idle engine speed NO to a maximum engine speed N2, while the ordinate is the lift L of each of the first intake valve 12A and the second intake valve 12B.

The broken line in FIG. 7 is the lift of the second intake valve 12B. In low engine speed area, the ordinate shows the minimum lift L1' as described above. With more increased engine speed N, the pressure oil acts on the second variable gear 2, to thereby switch the ordinate to a maximum lift L2' from an engine speed N1 (boundary).

Moreover, as is seen in FIG. 7, the shaded area (slant lines) surrounded by the solid lines shows an area in which the lift of the first intake valve 12A varies by means of the first variable gear 1. The solid line (upper) in FIG. 7 shows control during a heavy load operation. In the low engine speed area, the first intake valve 12A shows a lift L1 which is substantially equal to the lift L1' of the second intake valve 12B, while in high engine speed area, the first intake valve 12A shows a lift L2 which is substantially equal to the lift L2' of the second intake valve 12B. Therefore, from the low engine speed area to the maximum engine speed N2, the first intake valve 12A and the second intake valve 12B have substantially equal lift. Herein, the L1 is set larger than the Lmin above, while the L2 is set smaller than the Lmax above.

As is described in the above related art, a lift difference between the first intake valve 12A and the second intake valve 12B causes an intake air flow, to thereby cause an energy loss (equivalent to the intake air flow). The thus caused energy loss is responsible for reducing intake air filling efficiency, to thereby lower output torque. According to the first preferred embodiment, the first intake valve 12A and the second intake valve 12B are so set as to have substantially the equal lift. Thereby, the intake air loss (energy loss attributable to the intake air flow) is reduced. As a result, the output torque of the engine can be increased. Especially, as is seen in FIG. 7, the maximum lift L2 of the first intake valve 12A (by means of the first variable gear 1) is substantially equal to the maximum lift L2' of the second intake valve 12B (by means of the second variable gear 2), to thereby cause the maximum output and the maximum torque.

During the heavy load operation, the lift of the second variable gear 2 is so controlled as to increase stepwise in accordance with an increase in the engine speed, while the lift of the first variable gear 1 is so controlled as to become substantially similar to the lift of the second variable gear 2. This restricts any intake air loss (energy loss attributable to the intake air flow), and simultaneously preferably adjusts the lift in accordance with the engine speed. This can improve the intake air filling efficiency, to thereby increase the output torque of the engine.

Herein, the lift of the first intake valve 12A (by means of the first variable gear 1) varies continuously in a small area between an engine speed N1' and an engine speed N1", instead of varying quickly in the vicinity of the engine speed N1. Thereby, the continuous variation of the lift of the first intake valve 12A (by means of the first variable gear 1) has an advantage that switching shock is unlikely to be conveyed to the operator.

Stated below, on the other hand, is in terms of light load operation. As described above, the first intake valve 12A is controlled at the minimum lift L1 by means of the first variable gear 1. Herein, the minimum lift L1 is so controlled as to become far (or sufficiently) smaller than the minimum lift L1' of the second variable gear 2, causing a great lift difference. This great lift difference contributes to a strong intake air flow, to thereby improve combustion and reduce fuel consumption.

Moreover, as the load is increased, the combustion per se is bettered, to thereby increase gently the lift of the first variable gear 1. This allows the lift of the first intake valve 12A and the lift of the second intake valve 12B to become substantially similar to each other in the heavy load area as described above, to thereby improve output torque.

In addition, in order to cause the intake air flow, the lift difference between the first intake valve 12A and the second intake valve 12B may be provided as follows: The minimum lift L1 of the first intake valve 12A is larger than the minimum lift L1' of the second intake valve 12B (namely, lift height reversed).

There are described the following operation and effect attributable to the constitution, according to the first preferred embodiment:

The second variable gear 2 has a constitution for controlling the lift stepwise, instead of continuously. Therefore, the stepwise control has a simpler constitution than the continuous control, to thereby provide a simpler control than the continuous control. As a result, the entire variable valve system is free from enlargement in size and complexity in constitution, and is installed comfortably to the cylinder head 11. More specifically, the second variable gear 2 is less likely (or unlikely) to cause harmful effect on the installability of the variable valve system to the cylinder head 11 for the following feature: For switching lift, a switch mechanism of the second variable gear 2 has only two types of operating cams; namely, one is the movable cam 40 for a large lift, and the other is a flange portion (first flange portion 54 and second flange portion 55) for a small lift. It is only in the vicinity of each of the movable cam 40 and the flange portion (54, 55) that a space is occupied around the drive shaft 13, causing only a small upward bulge toward the control shaft 32 (FIG. 1).

Moreover, the first variable gear 1 is the one that variably controls the lift continuously by varying phase of the control shaft 32. Therefore, in view of the axial direction, it is only in the vicinity of the first intake valve 12A that a space is occupied around the drive shaft 13, not to say that a space is, as a matter of course, occupied around the control shaft 32. Therefore, the first variable gear 1 is less likely (or unlikely) to interfere with the second variable gear 2 that requires the space (for the movable cam 40, the first flange portion 54 and the second flange portion 55) principally in the vicinity of the second intake valve 12B. With the above 'less likely (or unlikely) interference', the installability of the variable valve system to the cylinder 11 is good (free from any harmful effect).

The second variable gear is not particularly limited to the one (second variable gear 2) according to the first preferred embodiment. For example, another second variable gear as is disclosed in Japanese Patent Application No. 2000-197556 is allowed. Moreover, the operation cam switch means is not limited to the one according to the first preferred embodiment. For example, another operation cam switch means disclosed in U.S. Pat. No. 5,046,462 {equivalent of Japanese Patent Unexamined Publication No. H3(1991)-130509} is allowed, in which the operation cam switch means is disposed on a follower side so as to abut on the cam, and achieves an effect same as that according to the first preferred embodiment of the present invention.

Figure 8:
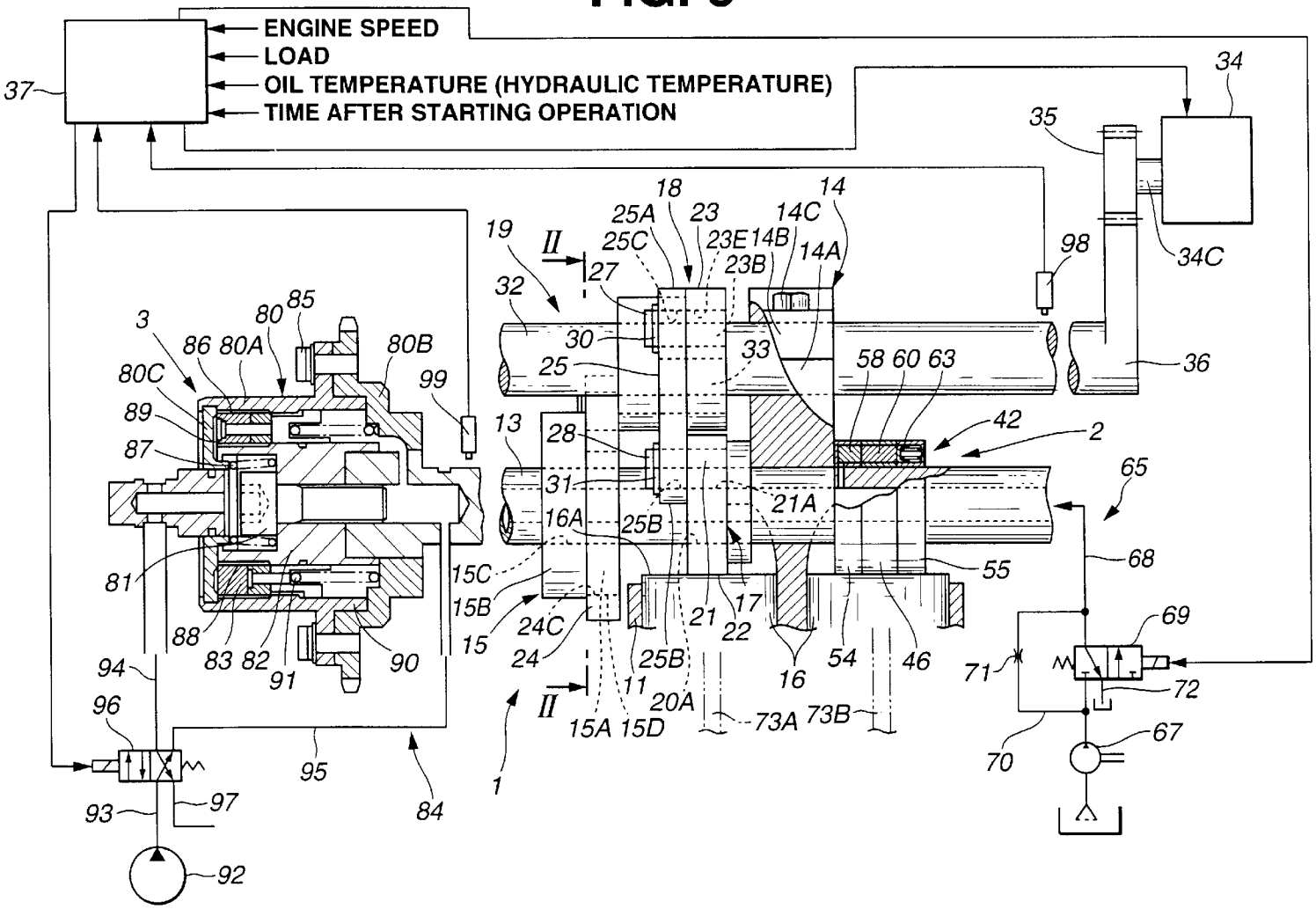
FIG. 8 is an essential side view of a variable valve system, according to a second preferred embodiment of the present invention.

As is seen in FIG. 8, there is provided a variable valve system, according to a second preferred embodiment of the present invention.

In the second preferred embodiment, the first variable gear 1 and the second variable gear 2 are disposed on an exhaust side. More specifically, the first variable gear 1 and the second variable gear 2 are, respectively, applied to a first exhaust valve 73A and a second exhaust valve 73B (namely, two exhaust valves for one cylinder). Moreover, there is provided a third variable gear 3 at the head end of the drive shaft 13. The third variable gear 3 is for controlling open/close timing of the first exhaust valve 73A and the second exhaust valve 73B in accordance with the engine operating condition.

As is seen in FIG. 8, the third variable gear 3 is constituted of a timing sprocket 80, a sleeve 82, a tubular gear 83, and an oil hydraulic circuit 84. The timing sprocket 80 receives a rotational force transmitted from a crank shaft of the engine by means of a timing chain (not shown). The sleeve 82 is fixed to the head end of the drive shaft 13 with a bolt 81 in the axial direction. The tubular gear 83 is intervened between the timing sprocket 80 and the sleeve 82. The oil hydraulic circuit 84 is a drive mechanism for driving the tubular gear 83 axially forward and backward relative to the drive shaft 13.

The timing sprocket 80 has a tubular body 80A, and a sprocket portion 80B which is fixed to a back end portion of the tubular body 80A with a bolt 85. The sprocket portion 80B is wound with the timing chain (not shown). The tubular body 80A has a front end hole which is blocked by a front cover 80C. Moreover, the tubular body 80A has an internal peripheral surface which is formed with an inner gear 86 shaped substantially into a helical gear.

The sleeve 82 has a back end portion which is formed with an engagement groove engaging with the head end portion of the drive shaft 13. Moreover, the sleeve 82 has a front end portion formed with a hold groove. In the hold groove of the sleeve 82, there is mounted a coil spring 87 for biasing the timing sprocket 80 forward by way of the front cover 80C. Moreover, the sleeve 82 has an external peripheral surface which is formed with an outer gear 88 shaped substantially into a helical gear.

The tubular gear 83 is bisected into two halves from a direction perpendicular to the shaft direction, in such a manner that a forward gear constitution and a backward gear constitution are biased toward each other by means of a pin and a spring. The tubular gear 83 has an internal peripheral surface formed with an internal gear teeth (shaped substantially into a helical gear) which meshes with the outer gear 88, and an external peripheral surface formed with an external gear teeth (shaped substantially into a helical gear) which meshes with the inner gear 86. Moreover, there is formed a first oil chamber 89 in a forward position of the tubular gear 83, while there is formed a second oil chamber 90 in a backward position of the tubular gear 83. The pressure oil is supplied to the first oil chamber 89 relative to the second oil chamber 90. The thus supplied pressure oil allows the internal gear teeth and the external gear teeth of the tubular gear 83 to slidably abut, respectively, on the outer gear 88 and the inner gear 86, to thereby move the tubular gear 83 forward and backward. In a foremost position of the tubular gear 83 (namely, a position where the tubular gear 83 abuts on the front cover 80C), the tubular gear 83 controls each of the first exhaust valve 73A and the second exhaust valve 73B at a most advanced angle. On the contrary, in a backmost position of the tubular gear 83, the tubular gear 83 controls each of the first exhaust valve 73A and the second exhaust valve 73B at a most delayed angle. Moreover, when the pressure oil in the first oil chamber 89 is not supplied to the tubular gear 83, a return spring 91 biases the tubular gear 83 to the foremost position. The return spring 91 is elastically mounted in the second oil chamber 90.

The oil hydraulic circuit 84 is constituted of a main gallery 93, a first oil passage 94, a second oil passage 95, a passage switch valve 96, and a drain passage 97. The main gallery 93 is connected to a downstream side of an oil pump 92 which communicates with an oil pan (not shown). The first oil passage 94 and the second oil passage 95 are divided on a downstream side of the main gallery 93, and are connected, respectively, to the first oil chamber 89 and the second oil chamber 90. The passage switch valve 96 is of a solenoid type, and is disposed at the above "division." The drain passage 97 is connected to the passage switch valve 96.

The passage switch valve 96 is operated by the control signal from the same controller 37 that controls the electric motor 34 of the first variable gear 1 in FIG. 1.

The controller 37 detects the engine operating condition from the various sensors. Moreover, the controller 37 outputs the control signal to the passage switch valve 96 based on a detection signal from a first position sensor 98 and a second position sensor 99. The first position sensor 98 detects a present rotational position of the control shaft 32, while the second position sensor 99 detects a rotational position of the drive shaft 13 relative to the timing sprocket 80.

The controller 37 determines a target advanced angle of each of the first exhaust valve 73A and the second exhaust valve 73B from an information signal from each of the sensor. Based on the thus obtained information signal, the passage switch valve 96 allows the first oil passage 94 to communicate with the main gallery 93 for a predetermined period, and also allows the second oil passage 95 to communicate with the drain passage 97 for the predetermined period. Thereby, the rotational position of the drive shaft 13 relative to the timing sprocket 80 is so converted, by way of the tubular gear 83, as to control the first exhaust valve 73A and the second exhaust valve 73B to the advanced angle and the delayed angle. Moreover, in this case, the second position sensor 99 monitors, in advance, the actual rotational position of the drive shaft 13 relative to the timing sprocket 80, to thereby rotate the drive shaft 13 by a target relative rotational position (namely, a target advanced angle) through a feedback control.

More specifically, for a predetermined period from the time engine starts operation to the time oil temperature reaches a predetermined value of T0, the passage switch valve 96 supplies the pressure oil only to the second oil chamber 90, leaving the first oil chamber 89 un-supplied with the pressure oil. Therefore, the tubular gear 83 is kept at the foremost position by dint of the spring force of the return spring 91, to thereby maintain the drive shaft 13 at the rotational position for the maximum advanced angle. Thereafter, when the oil temperature exceeds the predetermined temperature T0, the control signal from the controller 37 drives the passage switch valve 96 according to the engine operating condition, to thereby communicate the first oil passage 94 with the main gallery 93. Thereby, the time for allowing communication between the second oil passage 95 and the drain passage 97 becomes continuously variable. With this, the tubular gear 83 moves from the foremost position to the backmost position, to thereby allow open/close timing of each of the first exhaust valve 73A and the second exhaust valve 73B to be variably controlled from the most advanced angle to the most delayed angle.

According to the second preferred embodiment, the first variable gear 1 and the second variable gear 2 are disposed on the exhaust side, to thereby achieve as good an operational effect as is obtained from those disposed on the intake side in FIG. 1.

When the first exhaust valve 73A and the second exhaust valve 73B have a lift difference in, especially during engine's light load operation, increase in exhaust pipe temperature at cool engine start is accelerated due to exhaust air flow effect. This accelerates catalytic activation, to thereby reduce exhaust air.

Contrary to this, during heavy load operation, the lift of the second variable gear 2 increases stepwise in accordance with increase in the engine speed. Moreover, the lift of the first variable gear 1 is so controlled as to substantially equal to the lift of the second variable gear 2. Thereby, the air intake-exhaust loss for causing the exhaust air flow is reduced, and the exhaust air capability is improved, to thereby secure satisfactory output torque in accordance with the engine speed.

Described above is summarized as a synergistic effect of the first variable gear 1 and the second variable gear 2. Moreover, hereinafter described is a synergistic effect with the third variable gear 3 added to the first variable gear 1 and the second variable gear 2.

For example, in the low engine speed and light load area, controlling the open/close timing of each of the first exhaust valve 73A and the second exhaust valve 73B to the delayed angle enlarges overlap with the first intake valve 12A and the second intake valve 12B. Thereby, lift difference between the first exhaust valve 73A and the second exhaust valve 73B, attributable to the first variable gear 1 and the second variable gear 2 allows the exhaust air to cause a reverse air flow (exhaust air swirl) into the cylinder. Thereby, the exhaust air in the cylinder increases, and pump loss is reduced. With the thus reduced pump loss, deterioration of combustion is alleviated (improved), and the combustion is improved in accordance with the thus reduced pump loss.

Figure 9:
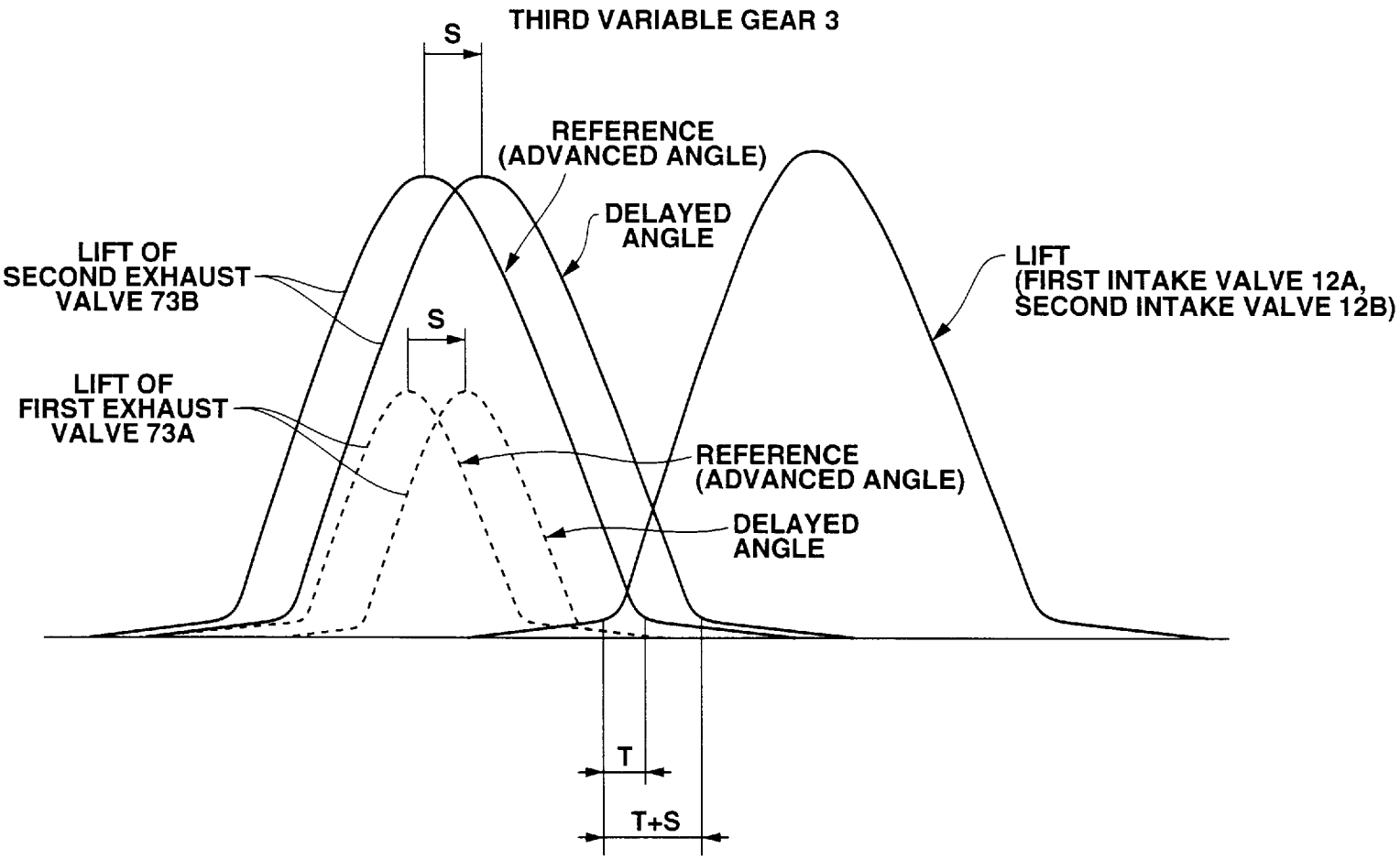
FIG. 9 shows valve lift characteristics relative to open/closed timing.

More specifically, as is seen in FIG. 9, the first exhaust valve 73A and the second exhaust valve 73B have the lift difference attributable to the first variable gear 1 and the second variable gear 2. In terms of the valve overlap (the first exhaust valve 73A and the second exhaust valve 73B overlapping with the first intake valve 12A and the second intake valve 12B), the lift characteristic (large lift) of the second exhaust valve 73B is positioned at a reference (advanced angle), showing a valve overlap T (small). Next, allowing the third variable gear 3 to control lift characteristic by delaying angle (a phase shift S) increases the valve overlap to "T+S". The first exhaust valve 73A shows a small lift curve, and therefore, originally has substantially no overlap with the first intake valve 12A and the second intake valve 12B. Thereby, the first exhaust valve 73A shows only a small overlap even when the third variable gear 3 causes the delayed angle (the phase shift S). Thereby, the first exhaust valve 73A scarcely causes the reverse air flow (the exhaust air swirl).

Therefore, a large amount of exhaust air causes a reverse flow from the second exhaust valve 73B into the cylinder by dint of vacuum pressure on the intake side. Due to the lift difference and the overlap difference between the first exhaust valve 73A and the second exhaust valve 73B, the above reverse flow of the exhaust air is likely to occur on the second exhaust valve 73B (biased to the second exhaust valve 73B). This causes a huge swirl air flow in the cylinder, to thereby improve combustion.

Figure 10:
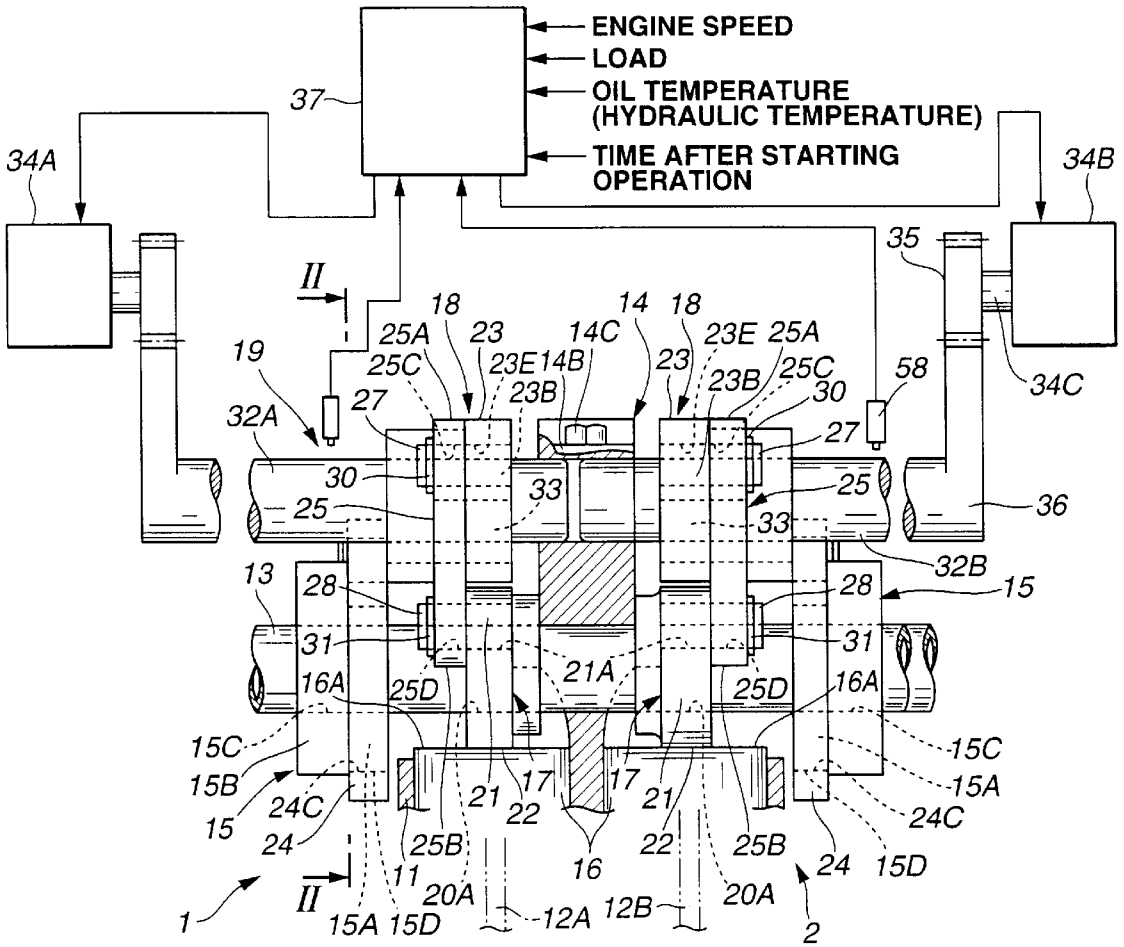
FIG. 10 is an essential side view of a variable valve system, according to a third preferred embodiment of the present invention.

As is seen in FIG. 10, there is provided a variable valve system, according to a third preferred embodiment of the present invention.

In the third preferred embodiment, the variable valve system is disposed on the intake side, and the second variable gear 2 has substantially the same constitution as that of the first variable gear 1. Thereby, not only the first intake valve 12A, but also the second intake valve 12B is allowed to have the lift variably controlled continuously. Moreover, the control shaft 32 is divided into a first control shaft 32A and a second control shaft 32B for controlling, respectively, the first variable gear 1 and the second variable gear 2 independently of each other.

More specifically, as is seen in FIG. 10, the first variable gear 1 and the second variable gear 2 are disposed in series on the drive shaft 13. The drive cam 15, the swing cam 17, and the transmission gear 18 of the second variable gear 2 have substantially the same constitution as those of the first variable gear 1. The first variable gear 1 and the second variable gear 2 are disposed substantially symmetrically to each other.

Moreover, the first variable gear 1 controls the lift of the first intake valve 12A by way of a first electric actuator 34A, while the second variable gear 2 controls the lift of the second intake valve 12B by way of a second electric actuator 34B (independent lift control). Moreover, controlling phase of the first control shaft 32A and phase of the second control shaft 32B independently of each other, as described above, achieves a continuous control from the minimum lift to the maximum lift.

Figure 11:
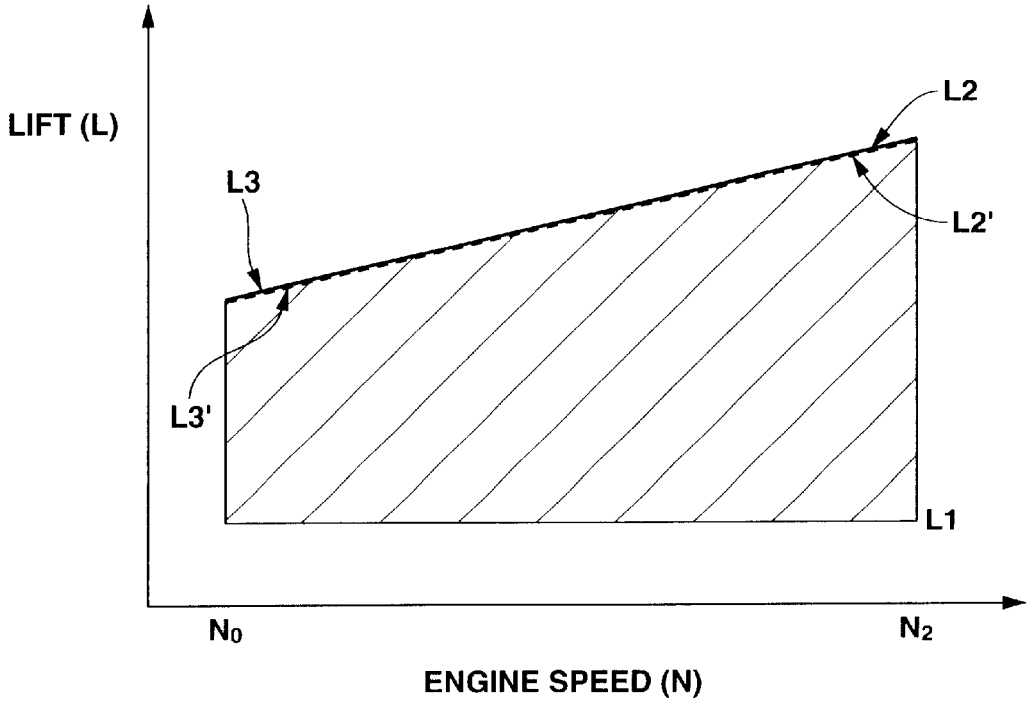
FIG. 11 shows valve lift characteristics by means of the first variable gear 1 and the second variable gear 2, according to the third preferred embodiment.

As is seen in FIG. 11, the lift of each of the first intake valve 12A and the second intake valve 12B is controlled, respectively, by the first variable gear 1 and the second variable gear 2. The solid line is lift characteristic by means of the first variable gear 1 during heavy load operation, while the broken line is lift characteristic by means of the second variable gear 2 during heavy load operation. The shaded area (slant lines) shows an area in which the lift of the first intake valve 12A varies by means of the first variable gear 1. The first intake valve 12A increases continuously from L3 to L2 corresponding, respectively, to from the idle engine speed N0 to the maximum engine speed N2, while the second intake valve 12B varies from L3' (substantially equal to L3) to L2' (substantially equal to L2).

This summarizes that the first intake valve 12A and the second intake valve 12B cause substantially no lift difference therebetween during heavy load operation, to thereby prevent the intake air flow from occurring and also prevent the intake air loss from increasing. Moreover, with increase in engine speed, the lift increases. Therefore, intake air filling efficiency is maximized at each engine speed, to thereby maximize output torque at each engine speed.

On the other hand, during light load operation, the first intake valve 12A shows a small lift L1, to thereby cause lift difference between the first intake valve 12A and the second intake valve 12B. The thus caused lift difference contributes to encouraging the intake air flow, to thereby reduce fuel consumption.

The heavier the engine load is, the more improved the combustion is. In accordance with this, the first intake valve 12A has its lift gently increased, to thereby reduce the lift difference between the first intake valve 12A and the second intake valve 12B. Then, at the maximum load, the first intake valve 12A and the second intake valve 12B substantially become equal to each other in terms of the lift.

Figure 12:
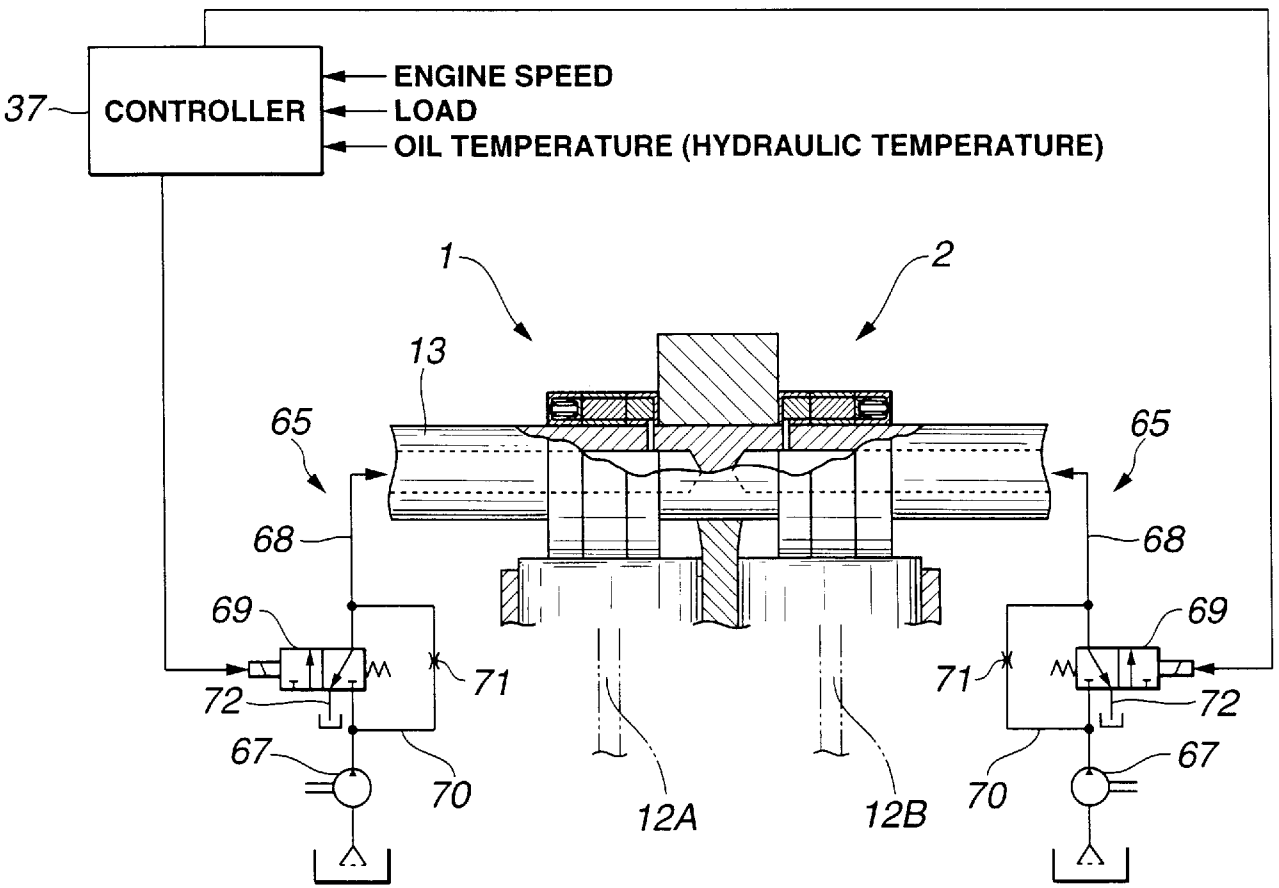
FIG. 12 is an essential side of a variable valve system, according to a fourth preferred embodiment of the present invention.

As is seen in FIG. 12, there is provided a variable valve system, according to a fourth preferred embodiment of the present invention.

The first variable gear 1 and the second variable gear 2, each disposed on the intake side according to the fourth preferred embodiment, have the same constitution as that of the second variable gear 2 according to the first preferred embodiment in FIG. 1. In the fourth preferred embodiment, parts and portions substantially the same are denoted by the same numerals, and repeated description thereof is omitted. Moreover, the first variable gear 1 and the second variable gear 2 are disposed substantially in series on the drive shaft 13, and are independent of each other in terms of constitution and operation. Each of the first variable gear 1 and the second variable gear 2 variably controls the valve characteristic (including lift) by two steps, to thereby simplify the constitution and prevent large size as well as complicated control.

Figure 13:
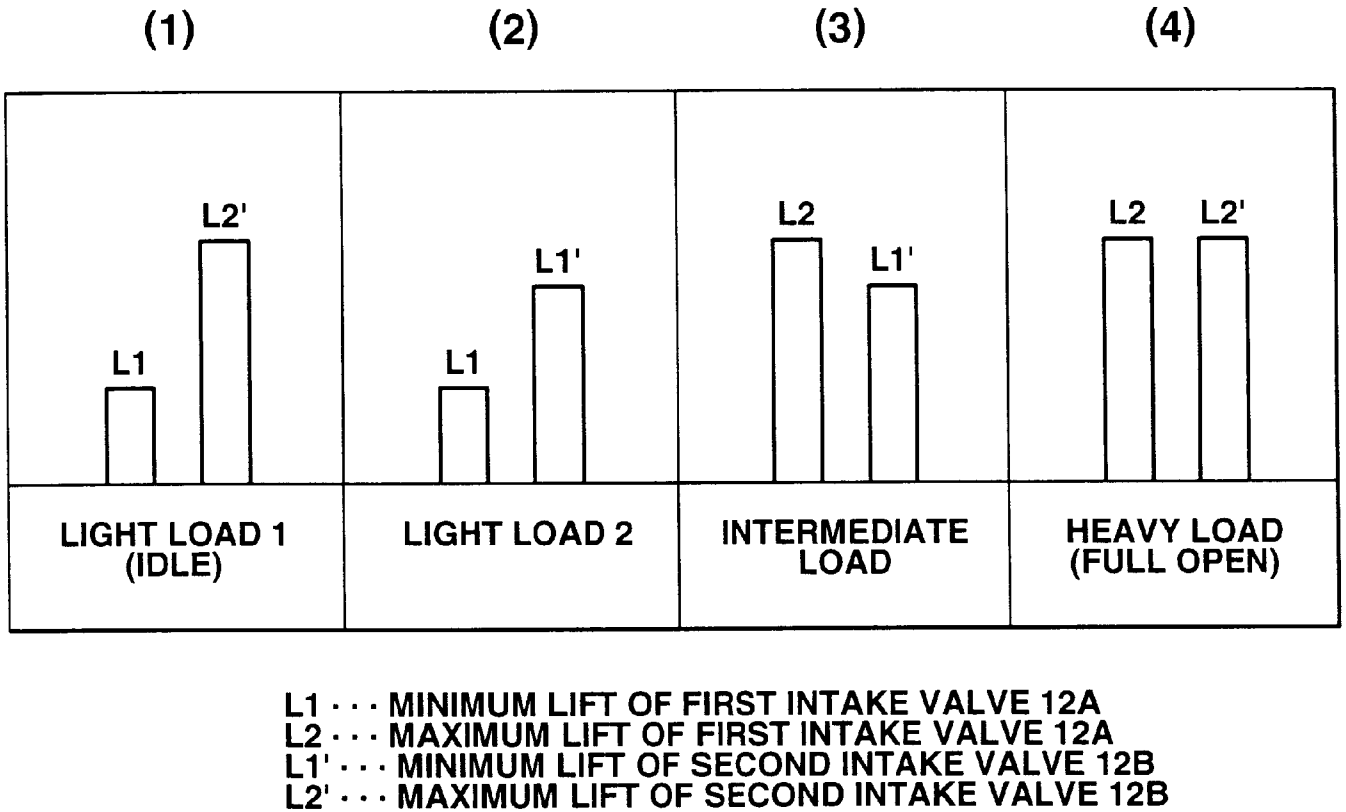
FIG. 13 shows valve lift characteristics by means of the first variable gear 1 and the second variable gear 2 categorized into four cases depending on engine operation, according to the fourth preferred embodiment.

As is seen in FIG. 13, four cases are exemplified which are specifically described as follows:

Case (1) During Light Load Operation 1 (Such as Idle Operation):

The first intake valve 12A is controlled at the minimum lift L1 by means of the first variable gear 1, while the second intake valve 12B is controlled at the maximum lift L2' by means of the second variable gear 2. Thereby, though the combustion is especially uncomfortable in this case (1), great lift difference contributes to great combustion improvement.

Case (2) During Light Load Operation 2 {a Little Heavier Load than Case (1) Above}:

The first intake valve 12A is controlled at the minimum lift L1, while the second intake valve 12B is controlled at the minimum lift L1' that is larger than the lift L1 of the first intake valve 12A. Under a little more comfortable combustion in the case (2) than the case (1) above, the lift difference is reduced, to thereby stabilize combustion and balance torque.

Case (3) During Intermediate Load Operation:

The first intake valve 12A is controlled at the maximum lift L2, while the second intake valve 12B is controlled at the minimum lift L1'. Under a considerably comfortable combustion in the case (3), the combustion is further improved. Thereby, the lift difference is small, to thereby sufficiently increase torque effect.

Case (4) During Heavy Load Operation (Full Open):

The first intake valve 12A is controlled at the maximum lift L2, while the second intake valve 12B is controlled at the maximum lift L2' that has substantially no lift difference from the maximum lift L2. Thereby, the best output torque effect is obtained.

This summarizes that various types of lift control as described above enable to achieve a sufficient engine performance in accordance with the engine operating condition.

More specifically, controlling the lift sequentially from (1), (2), (3), and (4) in accordance with increased engine load allows the lift difference between the first intake valve 12A and the second intake valve 12B to become variable into four steps (2×2) in accordance with the engine load. Thereby, the intake air flow is properly controlled.

Although the present invention has been described above by reference to four preferred embodiments, the present invention is not limited to the four preferred embodiments described above. Modifications and variations of the embodiments described above will occur to those skilled in the art, in light of the above teachings.

More specifically, driver (drive source) of each variable gear may be of any type; such as hydraulic, electric and the like. Furthermore, the first variable gear 1 and the second variable gear 2 can be driven by means of the same electric driver or the same hydraulic driver.

The entire contents of basic Japanese Patent Application No. P2000-295595 (filed Sep. 28, 2000) of which priority is claimed is incorporated herein by reference.

The scope of the present invention is defined with reference to the following claims.

What is claimed is:

1. A variable valve system for an internal combustion engine, the variable valve system comprising:

a plurality of valves provided for one cylinder of the internal combustion engine, the plurality of the valves being disposed on one of an intake side and an exhaust side of the one cylinder, the plurality of the valves comprising;

a first valve, and a second valve;

a first variable gear for variably controlling at least a lift of a valve lift characteristic of the first valve; and a second variable gear for variably controlling at least a lift of a valve lift characteristic of the second valve, in such a manner that the first variable gear and the second variable gear operate independently of each other.

2. The variable valve system for the internal combustion engine as claimed in claim 1, in which the first variable gear variably controls the lift of the first valve continuously in accordance with an engine operating condition.

3. The variable valve system for the internal combustion engine as claimed in claim 1, in which the second variable gear variably controls the lift of the second valve stepwise in accordance with an engine operating condition.

4. The variable valve system for the internal combustion engine as claimed in claim 1, in which the first variable gear comprises:

a drive shaft, a drive cam disposed on an external periphery of the drive shaft, a swing cam swingably supported to a support shaft and abutting on the first valve, the swing cam opening and closing the first valve by a swing motion of the swing cam, a transmission gear comprising a rocker arm disposed at an upper portion of the drive shaft, the rocker arm comprising;

a first end portion rotatably connected to the drive cam, and a second end portion rotatably connected to the swing cam, and a control shaft connected to the transmission gear; and in which a rotational position of the control shaft varies an attitude of the transmission gear so as to vary a position of the swing cam abutting on the first valve, to thereby vary the valve lift characteristic continuously.

5. The variable valve system for the internal combustion engine as claimed in claim 4, in which the support shaft for swingably supporting the swing cam is the drive shaft.

6. The variable valve system for the internal combustion engine as claimed in claim 1, in which the second variable gear comprises:

a plurality of cams arranged on a drive shaft for receiving a rotational drive force transmitted from the internal combustion engine; and a cam selector for selecting, from among the plurality of the cams, a cam that is responsible for lifting the second valve.

7. The variable valve system for the internal combustion engine as claimed in claim 1, in which the second variable gear comprises:

a drive shaft for receiving a rotational drive force transmitted from the internal combustion engine, a movable cam disposed on an external periphery of the drive shaft, the movable cam comprising a cam lift portion moving forward and backward in a direction of the second valve so as to open and close the second valve, the movable cam being for causing a lift having a predetermined height, a fixed cam fixed to the drive shaft, the fixed cam being for causing a lift having a predetermined height smaller than the predetermined height of the lift caused by the movable cam, a support pin for allowing the movable cam to rotate with the drive shaft, and an engagement-disengagement measures for engaging the movable cam with the drive shaft and for disengaging the movable cam from the drive shaft in accordance with an engine operating condition; and in which the engagement of the movable cam with the drive shaft, and the disengagement of the movable cam from the drive shaft are responsible for selecting the cam for lifting the second valve.

8. The variable valve system for the internal combustion engine as claimed in claim 1, in which a minimum lift of the first valve by means of the first variable gear is so controlled as to become different from a minimum lift of the second valve by means of the second variable gear.

9. The variable valve system for the internal combustion engine as claimed in claim 1, in which a maximum lift of the first valve by means of the first variable gear is so controlled as to become substantially equal to a maximum lift of the second valve by means of the second variable gear.

10. The variable valve system for the internal combustion engine as claimed in claim 1, in which, during a heavy engine load operation, a lift of the second valve by means of the second variable gear is so controlled as to increase stepwise in accordance with an increase in engine speed, while a lift of the first valve by means of the first variable gear is so controlled as to increase in accordance with the increase in engine speed in a manner substantially similar to a manner of the lift of the second valve by means of the second variable gear, and during a light engine load operation lighter than the heavy engine load operation, the lift of the first valve by means of the first variable gear and the lift of the second valve by means of the second variable gear are so controlled as to become different from each other.

11. The variable valve system for the internal combustion engine as claimed in claim 1, in which the second variable gear variably controls the lift of the second valve continuously.

12. The variable valve system for the internal combustion engine as claimed in claim 4, in which, the second variable gear has a constitution substantially similar to a constitution of the first variable gear, a first control shaft disposed at the first variable gear and a second control shaft disposed at the second variable gear operate independently of each other, and the first variable gear and the second variable gear continuously control the lift of the respective first valve and second valve independently of each other.

13. The variable valve system for the internal combustion engine as claimed in claim 12, in which the first variable gear and the second variable gear are substantially symmetrical to each other in constitution.

14. The variable valve system for the internal combustion engine as claimed in claim 11, in which, during a heavy engine load operation, a lift of the first valve by means of the first variable gear is so controlled as to become substantially equal to a lift of the second valve by means of the second variable gear, and the lift of the first valve by means of the first variable gear and the lift of the second valve by means of the second variable gear are so controlled as to increase continuously in accordance with an increase in engine speed; and during a light engine load operation lighter than the heavy engine load operation, the lift of the first valve by means of the first variable gear and the lift of the second valve by means of the second variable gear are so controlled as to become different from each other.

15. The variable valve system for the internal combustion engine as claimed in claim 1, in which each of the first variable gear and the second variable gear controls stepwise the lift of the respective first valve and second valve.

16. The variable valve system for the internal combustion engine as claimed in claim 1, further comprising a third variable gear for varying a phase of the valve lift characteristic of each of the plurality of the valves.

17. The variable valve system for the internal combustion engine as claimed in claim 1, in which the lift of the valve lift characteristic of each of the first variable gear and the second variable gear is a lift amount.

18. An internal combustion engine comprising:

a cylinder; and a variable valve system comprising;

a plurality of valves provided for the cylinder which is one in number, the plurality of the valves being disposed on one of an intake side and an exhaust side of the one cylinder, the plurality of the valves comprising;

a first valve, and a second valve;

a first variable gear for variably controlling at least a lift of a valve lift characteristic of the first valve; and a second variable gear for variably controlling at least a lift of a valve lift characteristic of the second valve, in such a manner that the first variable gear and the second variable gear operate independently of each other.

19. The internal combustion engine as claimed in claim 18, in which, the first variable gear variably controls the lift of the first valve continuously in accordance with an engine operating condition;

the second variable gear variably controls the lift of the second valve stepwise in accordance with the engine operating condition; and the lift of the valve lift characteristic of each of the first variable gear and the second variable gear is a lift amount.

20. The internal combustion engine as claimed in claim 18, in which, a minimum lift of the first valve by means of the first variable gear is so controlled as to become different from a minimum lift of the second valve by means of the second variable gear; and a maximum lift of the first valve by means of the first variable gear is so controlled as to become substantially equal to a maximum lift of the second valve by means of the second variable gear.

21. A variable valve system for an internal combustion engine, the variable valve system comprising:

a plurality of valves provided for one cylinder of the internal combustion engine, the plurality of the valves being disposed on one of an intake side and an exhaust side of the one cylinder, the plurality of the valves comprising;

a first valve, and a second valve;

a first means for variably controlling at least a lift of a valve lift characteristic of the first valve; and a second means for variably controlling at least a lift of a valve lift characteristic of the second valve, in such a manner that the first means and the second means operate independently of each other.

22. A variable valve system for an internal combustion engine, the variable valve system comprising:

a plurality of valves provided for one cylinder of the internal combustion engine, the plurality of valves being disposed on at least one of an intake side and an exhaust side of the one cylinder, the plurality of valves at the one of the intake side and the exhaust side comprising;

a first valve, and a second valve;

a first variable gear for variably controlling at least a lift of a valve lift characteristic of the first valve; and a second variable gear for variably controlling at least a lift of a valve lift characteristic of the second valve in such a manner that the first variable gear and the second variable gear operate independently of each other.

* * * * *